US010233749B2

(12) United States Patent
Anisur Rahman et al.

(10) Patent No.: US 10,233,749 B2
(45) Date of Patent: Mar. 19, 2019

(54) MULTI-LAYER RESERVOIR WELL DRAINAGE REGION

(71) Applicant: Saudi Arabian Oil Company, Dhahran (SA)

(72) Inventors: Noor M. Anisur Rahman, Dhahran (SA); Saud A. Bin Akresh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 146 days.

(21) Appl. No.: 15/585,528

(22) Filed: May 3, 2017

(65) Prior Publication Data

US 2018/0320512 A1 Nov. 8, 2018

(51) Int. Cl.
*E21B 47/06* (2012.01)
*E21B 43/30* (2006.01)
(Continued)

(52) U.S. Cl.
CPC ..... *E21B 49/00* (2013.01); *E21B 41/0092* (2013.01); *E21B 43/30* (2013.01); *E21B 47/06* (2013.01); *E21B 49/02* (2013.01)

(58) Field of Classification Search
CPC ..... E21B 43/30; E21B 47/06; E21B 41/0092; E21B 49/00
See application file for complete search history.

(56) References Cited

U.S. PATENT DOCUMENTS 3,079,085 A 2/1963 Clark et al.
5,548,563 A * 8/1996 Slevinsky ..... E21B 49/008 166/250.01
(Continued)

FOREIGN PATENT DOCUMENTS

CN 104504230 A 4/2015
WO WO2016115197 A1 7/2016
WO WO2016118711 A1 7/2016

OTHER PUBLICATIONS

Chengtai: "The Crossflow Behavior and the Determination of Reservoir Parameters by Drawdown Tests in Multilayer Reservoirs",—SPE 12580, Sep. 29, 1983, pp. 1-31.
(Continued)

*Primary Examiner* — Kenneth L Thompson
(74) *Attorney, Agent, or Firm* — Bracewell LLP; Constance G. Rhebergen; Christopher L. Drymalla

(57) ABSTRACT

Provided are systems and methods for developing a hydrocarbon reservoir including determining properties of a well including a wellbore extending into a tested layer of a multi-layer hydrocarbon reservoir including a barrier located between the tested layer and an adjacent layer of the multi-layer hydrocarbon reservoir, determining a point in time at which a value of a rate of influx of production fluid across the barrier from the adjacent layer and into the tested layer corresponds to a production contribution tolerance value for the well, determining a derivative of a profile of pressure in the targeted layer as a function of radial distance from the wellbore of the well at the point in time, and determining a drainage radius for the well corresponding to the derivative of the profile of pressure in the targeted layer and a pressure derivative tolerance value.

19 Claims, 9 Drawing Sheets

(51) Int. Cl.

| | |
|---|---|
| ***E21B 49/00*** | (2006.01) |
| ***E21B 41/00*** | (2006.01) |
| ***E21B 49/02*** | (2006.01) |

(56) References Cited

U.S. PATENT DOCUMENTS

| | | | | |
|---|---|---|---|---|
| 5,787,050 | A * | 7/1998 | Slevinsky | G01V 11/00 166/113 |
| 6,101,447 | A | 8/2000 | Poe | |
| 6,842,700 | B2 | 1/2005 | Poe | |
| 7,062,420 | B2 | 6/2006 | Poe | |
| 7,089,167 | B2 | 8/2006 | Poe | |
| 7,369,979 | B1 | 5/2008 | Spivey | |
| 8,032,345 | B2 | 10/2011 | Le Ravalec et al. | |
| 8,589,135 | B2 | 11/2013 | Middya et al. | |
| 8,898,017 | B2 | 11/2014 | Kragas et al. | |
| 9,151,868 | B2 * | 10/2015 | Levitan | E21B 49/00 |
| 9,488,752 | B2 | 11/2016 | Rahman et al. | |
| 9,880,302 | B2 * | 1/2018 | Wuestefeld | G01V 1/288 |
| 2003/0225522 | A1 | 12/2003 | Poe | |
| 2005/0015231 | A1 * | 1/2005 | Edwards | E21B 49/00 703/10 |
| 2011/0015909 | A1 | 1/2011 | Zhao | |
| 2014/0365183 | A1 * | 12/2014 | Embid Droz | E21B 41/0092 703/1 |
| 2016/0201452 | A1 | 7/2016 | Anisur et al. | |
| 2016/0208599 | A1 * | 7/2016 | Rahman | E21B 47/0005 |
| 2016/0305238 | A1 * | 10/2016 | Gottumukkala | E21B 47/065 |

OTHER PUBLICATIONS

International Search Report and Written Opinion for International Application No. PCT/US2018/030769; International Filing Date May 3, 2018; Report dated Aug. 10, 2018 (pp. 1-15).

Schrenkel: "Field Examples of Banier Detection With Unsteady-State Techniques", Fall Meeting of the Society of Petroleum Engineers of Aime, Oct. 11, 1961 (pp. 1-6).

Cheng-Tai, G.: "Single-Phase Fluid Flow in a Stratified Porous Medium With Crossflow," SPE Journal, pp. 97-106, Feb. 1984.

Ehlig-Economides, C.A. et al. "A New Test for Determination of Individual Layer Properties in a Multilayered Reservoir," SPE Formation Evaluation, pp. 261-283, Sep 1987.

Kuchuk, F.J: "Radius of Investigation for Reserve Estimation From Pressure Transient Well Tests," Paper SPE 120515 presented in SPE Middle East Oil and Gas Show and Conference, Manama, Bahrain, Mar. 15-18, 2009. pp. 1-21.

Rahman, N. M., et al. "Profiling Pressure-Derivative Values—A New, Innovative Way to Estimate the Radii of Investigation in Heterogeneous Reservoir Systems." SPE Middle East Oil and Gas Show and Conference. Society of Petroleum Engineers, 2013. pp. 1-1.

Stehfest, Harald; "Algorithm 368 Numerical Inversion of Laplace Transforms" Communications of the ACM vol. 13, No. 1, Jan. 1970; pp. 47-54.

* cited by examiner

MULTI-LAYER RESERVOIR WELL DRAINAGE REGION

FIELD

Embodiments relate generally to developing reservoirs, and more particularly to determining drainage regions of wells in multi-layer hydrocarbon reservoirs.

BACKGROUND

A well can include a borehole (or "wellbore") that is drilled into the earth to provide access to a geologic formation below the earth's surface (or "subsurface formation"). A portion of a subsurface formation that contains (or at least is expected to contain) mineral deposits is often referred to as a "reservoir". A reservoir that contains hydrocarbon, such as oil and gas, is often referred to as a "hydrocarbon reservoir". A well can facilitate the extraction of natural resources, such as hydrocarbons, from a subsurface formation, facilitate the injection of fluids into the subsurface formation, and facilitate the evaluation and monitoring of the subsurface formation. In the petroleum industry, wells are often drilled to extract (or "produce") hydrocarbons, such as oil and gas, from hydrocarbon reservoirs located in subsurface formations. The term "oil well" is often used to describe a well designed to produce oil. In the case of an oil well, some natural gas is typically produced along with oil. Wells producing both oil and natural gas are sometimes referred to as "oil and gas wells" or "oil wells." The term "gas well" is normally reserved to describe a well designed to produce primarily natural gas. The term "hydrocarbon well" is sometimes used to describe both oil and gas wells.

Creating a hydrocarbon well typically involves several stages, including drilling, completion and production. The drilling stage typically involves drilling a wellbore into a hydrocarbon reservoir in an effort to access the hydrocarbons trapped in the reservoir. The drilling process is often facilitated by a drilling rig that sits at the earth's surface. The drilling rig provides for operating a drill bit; hoisting, lowering and turning drill pipe and tools; circulating drilling fluids; and generally controlling operations in the wellbore (or "down-hole operations"). The completion stage typically involves making the well ready to produce hydrocarbons. In some instances, the completion stage includes lining portions of the wellbore and pumping fluids into the well to fracture, clean or otherwise prepare the reservoir to produce the hydrocarbons. The production stage typically involves extracting and capturing (or "producing") hydrocarbons from the reservoir via the well. During the production stage, the drilling rig is normally removed and replaced with a collection of valves (often referred to as a "production tree" or a "Christmas tree") that regulate pressure in the wellbore, control production flow from the wellbore, and provide access to the wellbore in the case further completion work is needed. A pump jack or other mechanism can provide lift that assists in extracting hydrocarbons from the reservoir, especially in instances where the pressure in the well is so low that the hydrocarbons do not flow freely up the wellbore to the surface. Flow from an outlet valve of the production tree is normally coupled to a distribution network, such as pipelines, storage tanks, and transport vehicles that transport the production to refineries, export terminals, and so forth.

In many instances, multiple wells are drilled into a reservoir. These wells are often referred to collectively as a "field" of wells. In an effort to efficiently produce hydrocarbons from a reservoir, well operators often commit a large amount of time and effort into generating field development plans (FDPs) that define various aspects of a field, including the number and locations of wells, paths (or "trajectories") for the wellbores of the wells, parameters for operating the wells and so forth. An FDP for a field is often based on knowledge of the underlying formation that is obtained, for example, via seismic imaging, laboratory testing of samples extracted from the formation, testing of existing wells, and so forth. Well operators typically drill and operate wells according to an FDP. For example, where an FDP specifies well locations and well trajectories for a number of wells, the operator may drill each of the wells at a respective one of the well locations and with the corresponding well trajectory.

In some instances, well locations are determined based on "drainage regions" for the wells. The drainage region for a hydrocarbon well can define the area within the hydrocarbon reservoir from which the well is expected to produce hydrocarbons. Hydrocarbons are expected to flow from the drainage region, into the wellbore during production operations. Thus, it can be expected that all or almost all of the production for a well will originate from within the drainage region for the well, although some production may migrate into the drainage region from surrounding portions of the reservoir. A drainage region for a well may be defined, for example, by a radius around the wellbore. This radius can define what is referred to as the "drainage boundary" for the well.

In many instances, development of an FDP takes into account the drainage regions for wells in the field when positioning the wells. For example, when developing an FDP an operator may position wells so that they are close enough to cover the entirety of the reservoir, but not so close that their drainage regions overlap significantly, resulting in the wells competing for production. The positioning of the wells often involves a consideration of the distance between adjacent wells (or "well spacing").

SUMMARY

Applicants have recognized that defining appropriate well spacing can be crucial in the development of a successful field development plan (FDP) for a hydrocarbon reservoir. For example, if the wells are spaced appropriately each well will produce hydrocarbons from given region of the reservoir, and the wells as a whole will produce most if not all of the producible hydrocarbons from the reservoir. If the well spacing is too small, however, more wells than are needed to produce the hydrocarbons from the reservoir may be drilled, resulting in an inefficient development of the field that includes additional time and costs attributable to drilling and operating additional wells. On the other hand, if the well spacing is too large, the wells may not effectively cover the reservoir such that producible hydrocarbons are not extracted from the regions of the reservoir between the drilled wells, resulting in lost revenue attributable to unextracted hydrocarbons that remain between the wells. Determinations of well spacing often relies on accurate modeling of wells and reservoirs and, thus, accurate modeling of well and reservoir performance can be a crucial step in developing a successful FDP. This can include modeling how the wells are expected to perform over an extended period of time (e.g., months, years or decades).

Applicants have recognized that many different factors can contribute to the performance of a well over time, including specific characteristics of the reservoir in which it is drilled. For example, in the context of a single-layer reservoir or multi-layer reservoir, a well can be drilled and operated to produce hydrocarbons from a particular layer of the reservoir. Often times, this layer is the target of production for the well and has been subjected to a number of different tests. Such a layer is often referred to as the "target layer" or "tested layer" of the reservoir. The tested layer may be defined by barriers, such as geological boundaries located above and below the tested layer. In some instances, a barrier is impermeable or semi-permeable. An impermeable barrier can include, for example, a solid layer of rock that blocks the flow of hydrocarbons from an adjacent layer. Thus, there may not be any substantial hydraulic communication between two adjacent layers separated by an impermeable barrier. A semi-permeable barrier can include, for example, a porous layer of rock that generally inhibits the flow of hydrocarbons across the barrier, but that does allow at least some hydrocarbons to flow there through. Thus, there may be at least some hydraulic communication between two adjacent layers separated by a permeable barrier. In the case of a well drilled into a tested layer surrounded by impermeable barriers (e.g., a tested layer having solid layers of rock defining upper and lower boundaries of the tested layer), the well may produce hydrocarbons from the tested layer and not produce any hydrocarbons from adjacent layers located above and below the tested layer. That is hydrocarbons may flow from the tested layer into the wellbore; but hydrocarbons in the adjacent layers may be blocked by the impermeable barriers from flowing into the tested layer and the wellbore. In the case of well drilled into a tested layer surrounded by a semi-permeable barrier (e.g., having a porous layers of rock defining at least one of the upper and lower boundaries of the target layer), the well may produce hydrocarbons from the target layer and at least one of the adjacent layers above and below the target layer. That is hydrocarbons may flow from the tested layer into the wellbore, and at least some hydrocarbons in the adjacent layers may flow across the semi-permeable barrier(s) into the tested layer and the wellbore.

When the tested layer is isolated from adjacent layers via impermeable barriers, a well model can be developed that includes a drainage region based on the flow of hydrocarbons from the tested layer of the reservoir. Applicants have recognized, however, that the existence of semi-permeable barriers can introduce more variables and complications into the modeling of wells. For example, the existence of a semi-permeable barrier at a tested layer of a well can introduce additional production flow from one or more adjacent layers that need to be accounted for to accurately model the well. Specifically, the "specific fluid permeability" of a semi-permeable barrier controls the rate of cross-flow of hydrocarbons from an adjacent layer to the tested layer, for example, due to wells producing hydrocarbons from the tested layer. This also controls the growth of drainage area around each well producing from the tested layer. With time, a producing well can produce substantially from the adjacent layer, through the semi-permeable barrier. This can cause the drainage radius around a producing well in the tested layer to be smaller than expected as the well produces oil from the adjacent layer instead of the farther reaches of the tested layer. As a result, the well may produce a substantially less oil from the tested layer, resulting in a relatively small drainage region when compared to wells for tested layers with impermeable boundaries.

Unfortunately, existing well modeling techniques do not take into consideration additional production flow from adjacent layers that is attributable to semi-permeable barriers. As a result, existing well modeling techniques cannot provide accurate well models for wells in tested layers having semi-permeable barriers. Moreover, the lack of accurate well models for wells in tested layers having semi-permeable barriers can result in determination of sub-optimal well spacings for wells in the tested layers with semi-permeable barriers, which can in turn result in sub-optimal FDPs and inefficient development of reservoirs having tested layers with semi-permeable barriers.

Recognizing these and other shortcomings of existing well modeling techniques, Applicants have developed novel systems and methods for modeling wells, including novel techniques for determining well drainage regions for wells in tested layers having semi-permeable barriers. These improved determinations of well drainage regions can be used, for example, to determine optimal well spacings and FDPs, and to effectively develop hydrocarbon reservoirs with tested layers having semi-permeable barriers.

Provided in some embodiments is a method of developing a hydrocarbon reservoir. The method including: drilling a well including a wellbore extending into a tested layer of a multi-layer hydrocarbon reservoir, the well located at a first well site; identifying a barrier located between the tested layer and an adjacent layer of the multi-layer hydrocarbon reservoir; determining properties of the well including a specific fluid permeability of the barrier; determining, based on the specific fluid permeability of the barrier, a pressure drawdown of the well including a profile of pressure at the wellbore of the well over a period of time; determining, based on the pressure drawdown of the well, a pressure derivative of the well including a derivative of the profile of the pressure at the wellbore of the well over the period of time; determining a production contribution of the adjacent layer including a profile of a rate of influx of production fluid across the barrier from the adjacent layer and into the tested layer over the period of time; determining a total production rate for the well; determining a production contribution tolerance value for the well including a portion of the total production rate for the well; determining, based on the production contribution of the adjacent layer, a first point in time corresponding to the production contribution tolerance value, the first point in time including a point in time at which a value of the profile of the rate of influx of production fluid across the barrier from the adjacent layer and into the tested layer corresponds to the production contribution tolerance value for the well; determining, based on the pressure derivative of the well, a first pressure corresponding to the first point in time, the first pressure including a value of the derivative of the profile of pressure at the wellbore at the first point in time; determining, based on the specific fluid permeability of the barrier, a reservoir pressure of the well corresponding to the first point in time including a profile of pressure in the targeted layer as a function of radial distance from the wellbore of the well at the first point in time; determining, based on the reservoir pressure of the well corresponding to the first point in time, a reservoir pressure derivative of the well corresponding to the first point in time including a derivative of the profile of pressure in the targeted layer as a function of radial distance from the wellbore of the well at the first point in time; determining a pressure derivative tolerance value for the well including a portion of the reservoir pressure of the well corresponding to the first point in time; determining, based on the reservoir pressure derivative corresponding to the first point in time, a radial distance corresponding to the pressure derivative tolerance value; determining a drainage radius for the well corresponding to the radial distance; determining a well spacing based on the drainage radius for the well; and drilling a second well at a second well site located a distance from the first well site, the distance corresponding to the well spacing.

In some embodiments, the specific fluid permeability of the barrier indicates an ability of fluids to migrate through the barrier, and determining properties of the well includes determining that the specific fluid permeability of the barrier has a magnitude that is greater than zero. In certain embodiments, determining properties of the well includes conducting one or more of a logging operation, a well test operation, and a sample analysis operation. In some embodiments, the production contribution tolerance value for the well includes a product of the total production rate for the well and a production contribution tolerance percentage.

In certain embodiments, the method further includes: determining, based on the specific fluid permeability of the barrier, a time-lapse of reservoir pressure in the targeted layer including a plurality of profiles of pressure in the targeted layer as a function of radial distance from the wellbore of the well at different points in time, where each profile of the plurality of profiles of pressure in the targeted layer includes a profile of pressure in the targeted layer as a function of radial distance from the wellbore of the well at a point in time of the different points in time; and determining, based on the time-lapse of a reservoir pressure of the well, time-lapse of a derivative of reservoir pressure of the well including a plurality of profiles of a derivative reservoir pressure for the well at different points in time, where each pressure derivative profile of the plurality of pressure derivative profiles for the well includes a derivative of a profile of pressure in the targeted layer as a function of radial distance from the wellbore of the well at a point in time of the different points in time, where one of the different points in time corresponds to the first point in time, where determining the reservoir pressure of the well corresponding to the first point in time including the profile of pressure in the targeted layer as a function of radial distance from the wellbore of the well at the first point in time includes determining the profile of the plurality of profiles of pressure in the targeted layer corresponding to the first point in time, and where determining the pressure derivative of the well including a derivative of the profile of the pressure at the wellbore of the well over the period of time includes determining the profile of the plurality of profiles of the derivative reservoir pressure for the well corresponding to the first point in time.

In some embodiments, the well spacing is twice the drainage radius for the well. In some embodiments, the method further includes generating a field development plan (FDP) including a plurality of well sites having well spacings corresponding to the well spacing determined.

Provided in some embodiments is a method of developing a hydrocarbon reservoir. The method including: determining properties of a well located at a first well site and including a wellbore extending into a tested layer of a multi-layer hydrocarbon reservoir including a barrier located between the tested layer and an adjacent layer of the multi-layer hydrocarbon reservoir, the properties of the well including a specific fluid permeability of the barrier; determining, based on the specific fluid permeability of the barrier, a pressure derivative of the well including a derivative of a profile of the pressure at the wellbore well over a period of time; determining a production contribution of the adjacent layer including a profile of a rate of influx of production fluid across the barrier from the adjacent layer and into the tested layer over the period of time; determining a total production rate for the well; determining a production contribution tolerance value for the well including a portion of the total production rate for the well; determining, based on the production contribution of the adjacent layer, a first point in time corresponding to the production contribution tolerance value, the first point in time including a point in time at which a value of the profile of the rate of influx of production fluid across the barrier from the adjacent layer and into the tested layer corresponds to the production contribution tolerance value for the well; determining, based on the pressure derivative of the well, a first pressure corresponding to the first point in time, the first pressure including a value of the derivative of the profile of pressure at the wellbore at the first point in time; determining, based on the specific fluid permeability of the barrier, a reservoir pressure derivative of the well corresponding to the first point in time including a derivative of a profile of pressure in the targeted layer as a function of radial distance from the wellbore of the well at the first point in time; determining a pressure derivative tolerance value for the well including a portion of the reservoir pressure of the well corresponding to the first point in time; determining, based on the reservoir pressure derivative corresponding to the first point in time, a radial distance corresponding to the pressure derivative tolerance value; and determining a drainage radius for the well corresponding to the radial distance.

In some embodiments, the specific fluid permeability of the barrier indicates an ability of fluids to migrate through the barrier, and where determining properties of the well includes determining that the specific fluid permeability of the barrier has a magnitude that is greater than zero. In certain embodiments, determining properties of the well includes conducting one or more of a logging operation, a well test operation, and a sample analysis operation. In some embodiments, the production contribution tolerance value for the well include product of the total production rate for the well and a production contribution tolerance percentage.

In certain embodiments, the method further includes: determining, based on the specific fluid permeability of the barrier, the pressure drawdown of the well including the profile of pressure at the wellbore of the well over the period of time; and determining, based on the specific fluid permeability of the barrier, the reservoir pressure of the well corresponding to the first point in time including the profile of pressure in the targeted layer as a function of radial distance from the wellbore of the well at the first point in time.

In some embodiments, the method further includes: determining, based on the specific fluid permeability of the barrier, a time-lapse of reservoir pressure in the targeted layer including a plurality of profiles of pressure in the targeted layer as a function of radial distance from the wellbore of the well at different points in time, where each profile of the plurality of profiles of pressure in the targeted layer includes a profile of pressure in the targeted layer as a function of radial distance from the wellbore of the well at a point in time of the different points in time; and determining, based on the time-lapse of a reservoir pressure of the well, time-lapse of a derivative of reservoir pressure of the well including a plurality of profiles of a derivative reservoir pressure for the well at different points in time, where each pressure derivative profile of the plurality of pressure derivative profiles for the well includes a derivative of a profile of pressure in the targeted layer as a function of radial distance from the wellbore of the well at a point in time of the different points in time, where one of the different points in time corresponds to the first point in time, where determining the reservoir pressure of the well corresponding to the first point in time including the profile of pressure in the targeted layer as a function of radial distance from the wellbore of the well at the first point in time includes determining the profile of the plurality of profiles of pressure in the targeted layer corresponding to the first point in time, and where determining the pressure derivative of the well including a derivative of the profile of the pressure at the wellbore of the well over the period of time includes determining the profile of the plurality of profiles of the derivative reservoir pressure for the well corresponding to the first point in time.

In certain embodiments, the profile of pressure in the targeted layer as a function of radial distance from the wellbore of the well at the first point in time is determined according to the following:

$$\Delta\overline{p}_{wf}(r, l) = \frac{qB_0\left\{K_0(\sigma_1 r) - \frac{\beta_1}{\beta_2}K_0(\sigma_2 r)\right\}}{l\left[24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}\right]},$$

where $\Delta\overline{p}_{wf}(r, l)$ is the pressure at the radial distance (r) from the longitudinal axis of the wellbore of the well at the first point in time, and where $$\beta_1 = -\frac{F_{cb}}{\kappa_2\sigma_1^2 - F_{cb} - F_2 l}, \beta_2 = -\frac{F_{cb}}{\kappa_2\sigma_2^2 - F_{cb} - F_2 l},$$

$$\sigma_1^2 = \frac{Y + \sqrt{Y^2 - 4Z}}{2}, \sigma_2^2 = \frac{Y - \sqrt{Y^2 - 4Z}}{2},$$

$$F_1 = \frac{\phi_1\mu h_1 c_{t1}}{0.0002637}, F_2 = \frac{\phi_2\mu h_2 c_{t2}}{0.0002637},$$

$$\kappa_1 = k_1 h_1, \kappa_2 = k_2 h_2,$$

$$Y = \frac{\kappa_1(F_{cb} + F_2 l) + \kappa_2(F_{cb} + F_1 l)}{\kappa_1\kappa_2},$$

$$Z = \frac{(F_{cb} + F_2 l)(F_{cb} + F_1 l) - F_{cb}^2}{\kappa_1\kappa_2}, r_{wa1} = r_{w1}\exp(-s_1),$$

$$\alpha_1 = \frac{k_1 h_1 r_{w1}}{141.2\mu}, F_{cb} = \frac{2k_{v0}k_{v1}k_{v2}}{2h_0k_{v1}k_{v2} + h_1k_{v0}k_{v2} + h_2k_{v0}k_{v1}},$$

$F_{cb}$ is the specific fluid permeability of the barrier,
l is a Laplace transform parameter,
$k_1$ is permeability in the radial direction in the tested layer,
$k_2$ is permeability in the radial direction in the adjacent layer,
$k_{v0}$ is permeability in the vertical direction in the barrier,
$k_{v1}$ is permeability in the vertical direction in the tested layer,
$k_{v2}$ is permeability in the vertical direction in the adjacent layer,
$\phi_1$ is a porosity of the tested layer,
$\phi_2$ is a porosity of the adjacent layer,
$h_0$ is a thickness of the barrier between the tested and the adjacent layers, $h_1$ is a pay thickness of the tested layer,
$h_2$ is a pay thickness of the adjacent layer,
$\kappa_1$ is a flow capacity in the tested layer, $k_1h_1$,
$\kappa_2$ is a flow capacity in the adjacent layer, $k_2h_2$,
$c_{t1}$ is a total system compressibility of the tested layer,
$c_{t2}$ is a total system compressibility of the adjacent layer,
$B_o$ is a formation volume factor of fluid in both of the tested layer and the adjacent layer,
C is a wellbore storage constant (having units of bbl/psia),
$s_1$ is a skin factor of the well in the tested layer,
$\mu$ is a viscosity of fluid in both the tested layer and the adjacent layer,
$r_{w1}$ is a radius of the wellbore,
q is a rate of production for the well,
$K_0(\ )$ is a modified Bessel function of the second kind of order 0, and
$K_1(\ )$ is a modified Bessel function of the second kind of order 1.

In some embodiments, the derivative of the profile of pressure in the targeted layer as a function of radial distance from the wellbore of the well at the first point in time is determined according to the following:

$$\overline{p}'(r, l) = \frac{qB_0\left\{K_0(\sigma_1 r) - \frac{\beta_1}{\beta_2}K_0(\sigma_2 r)\right\}}{24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}},$$

where $\overline{p}'(r, l)$ is a derivative of pressure in the Laplace domain at a radial distance (r) from a longitudinal axis of the wellbore of the well.

In certain embodiments, the method further includes determining a well spacing based on the drainage radius for the well. In some embodiments, the method further includes drilling a second well at a second well site located a distance from the first well site, the distance corresponding to the well spacing.

Provided in some embodiments is a non-transitory computer readable medium including program instructions stored thereon that are executable by a processor to perform operations for developing a hydrocarbon reservoir of the method described above.

Provided in some embodiments is a system for developing a hydrocarbon reservoir. The system including a well processing system adapted to: determine properties of a well located at a first well site and including a wellbore extending into a tested layer of a multi-layer hydrocarbon reservoir including a barrier located between the tested layer and an adjacent layer of the multi-layer hydrocarbon reservoir, the properties of the well including a specific fluid permeability of the barrier; determine, based on the specific fluid permeability of the barrier, a pressure derivative of the well including a derivative of a profile of the pressure at the wellbore well over a period of time; determine a production contribution of the adjacent layer including a profile of a rate of influx of production fluid across the barrier from the adjacent layer and into the tested layer over the period of time; determine a total production rate for the well; determine a production contribution tolerance value for the well including a portion of the total production rate for the well; determine, based on the production contribution of the adjacent layer, a first point in time corresponding to the production contribution tolerance value, the first point in time including a point in time at which a value of the profile of the rate of influx of production fluid across the barrier from the adjacent layer and into the tested layer corresponds to the production contribution tolerance value for the well; determine, based on the pressure derivative of the well, a first pressure corresponding to the first point in time, the first pressure including a value of the derivative of the profile of pressure at the wellbore at the first point in time; determine, based on the specific fluid permeability of the barrier, a reservoir pressure derivative of the well corresponding to the first point in time including a derivative of a profile of pressure in the targeted layer as a function of radial distance from the wellbore of the well at the first point in time; determine a pressure derivative tolerance value for the well including a portion of the reservoir pressure of the well corresponding to the first point in time; determine, based on the reservoir pressure derivative corresponding to the first point in time, a radial distance corresponding to the pressure derivative tolerance value; and determine a drainage radius for the well corresponding to the radial distance. The system including a drilling system adapted to drill one or more wells into the tested layer of the multi-layer hydrocarbon reservoir according to a well spacing determined based on the drainage radius for the well.

Figure 1:
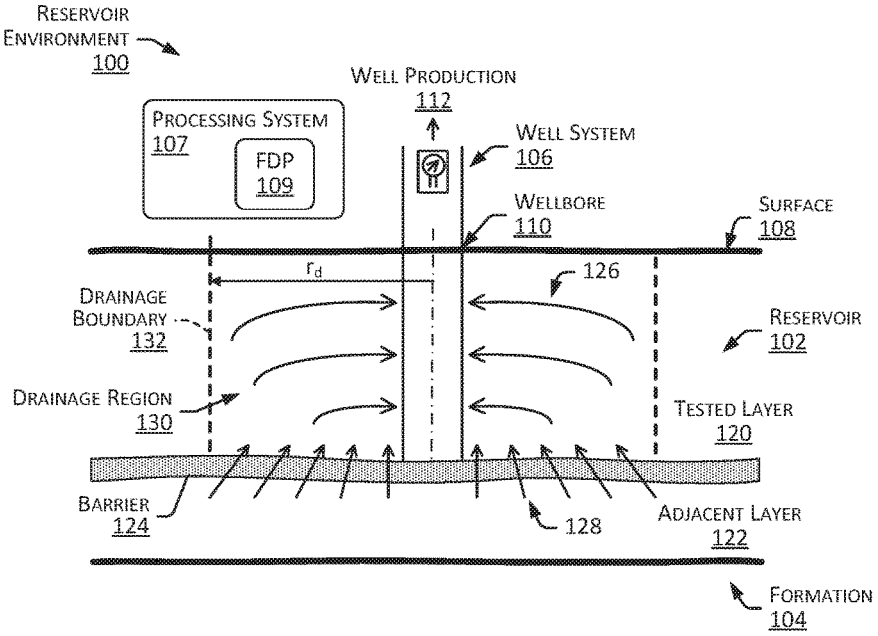
FIG. 1 is a diagram that illustrates a hydrocarbon reservoir environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the spirit and scope of the present disclosure as defined by the claims.

DETAILED DESCRIPTION

Described are embodiments of systems and methods for developing multi-layer hydrocarbon reservoirs. In some embodiments, one or more production wells for producing hydrocarbons from a tested layer of a multi-layer hydrocarbon reservoir are modeled using novel techniques for determining well drainage regions for wells in tested layers having semi-permeable barriers. In some embodiments, the modeling includes assessing hydrocarbon production contributions of adjacent layers of the multi-layer hydrocarbon reservoir. This can include, for example, considerations of a flow of hydrocarbons from an adjacent layer, across a semi-permeable barrier, and into the tested layer and the wellbore of the well. In some embodiments, the characteristics of the drainage region are used to determine well spacings. For example, a radius of the drainage region for a first well and a radius of a drainage region for a second well can be added to determine an appropriate well spacing between the first and second wells. In some embodiments, the well spacings are used to generate a field development plan (FDP). For example, the FDP may specify well locations and well trajectories that correspond to the well spacings determined. In some embodiments, the multi-layer hydrocarbon reservoir is developed according to the FDP. For example, wells can be drilled at one or more of the locations specified in the FDP. Thus, the determinations of well drainage regions can be used, for example, to determine optimal well spacings and FDPs, and to effectively develop hydrocarbon reservoirs with tested layers having semi-permeable barriers.

FIG. 1 is a diagram that illustrates a reservoir environment 100 in accordance with one or more embodiments. In the illustrated embodiment, the reservoir environment 100 includes a hydrocarbon reservoir ("reservoir") 102 located in a subsurface formation ("formation") 104, and a well system ("well") 106. In some embodiments, the well 106 includes a processing system 107 for performing some or all of the processing and/or control operations described herein. The processing system 107 can include a computer system, such as the computer system 1000 depicted and described with regard to FIG. 8. As described herein, analytical operations can be used to determine well spacing and locations for well sites of a field development plan (FDP) 109.

The formation 104 may include a porous or fractured rock formation that resides underground, beneath the earth's surface ("surface") 108. The reservoir 102 may include a portion of the formation 104 that contains, or is at least determined or expected to contain, a subsurface pool of hydrocarbons, such as oil and gas. The reservoir 102 may include different layers of rock having varying characteristics, such as varying degrees of permeability, porosity, and resistivity.

The well 106 may include a wellbore 110 that extends into the reservoir 102. The wellbore 110 may include a bored hole that enters the surface 108 at a surface location of the well 106, and extends through the formation 104 into a target zone or location, such as the reservoir 102. The wellbore 120 can, for example, be created by a drill bit of a drilling system boring through the formation 104 and into the reservoir 102. The wellbore 120 can provide for the circulation of drilling fluids during drilling operations, the flow of hydrocarbons (e.g., oil and gas) to the surface 108 from the reservoir 102 during production operations, the injection of fluids into one or both of the formation 104 and the reservoir 102 during injection operations, and the communication of monitoring devices (e.g., pressure gauges, flow meters, and logging tools) into one or both of the formation 104 and the reservoir 102 during monitoring operations (e.g., during well monitoring, well tests, and in situ logging operations). In some embodiments, the well 106 is operated as a production well to extract (or "produce") hydrocarbons from the reservoir 102, as represented by well production 112.

A reservoir that include multiple layers of hydrocarbons separated by one or more barriers (impermeable or semi-permeable) may be referred to as a "multi-layer reservoir". In the context of a multi-layer reservoir, a well can be drilled and operated to produce hydrocarbons from a particular layer of the reservoir. Often times, this layer is the target of production for the well and has been subjected to a number of different tests. Such a layer is often referred to as the "target layer" or "tested layer" of the reservoir. The tested layer may be defined by one or more barriers, such as geological boundaries located above and/or below the tested layer. In some instances, a barrier is impermeable or semi-permeable. An impermeable barrier can include, for example, a solid layer of rock that blocks the flow of hydrocarbons. Thus, there may not be any substantial hydraulic communication between two adjacent layers separated by an impermeable barrier. A semi-permeable barrier can include, for example, a porous layer of rock that generally inhibits the flow of hydrocarbons across the barrier, but that does allow at least some hydrocarbons to flow there through. Thus, there may be at least some hydraulic communication between two adjacent layers separated by a permeable barrier. In the case of well drilled into a tested layer surrounded by impermeable barriers (e.g., a tested layer having solid layers of rock defining the upper and/or lower boundaries of the tested layer), the well may produce hydrocarbons from the tested layer and not produce any hydrocarbons from adjacent layers located above and/or below the tested layer. That is hydrocarbons may flow from the tested layer into the wellbore; but hydrocarbons in the adjacent layers may be blocked by the impermeable barriers from flowing into the tested layer and the wellbore. In the case of a well drilled into a tested layer surrounded by one or more semi-permeable barriers (e.g., having a porous layers of rock defining the upper and/or lower boundaries of the tested layer), the well may produce hydrocarbons from the target layer and at least one of the adjacent layers above and below the target layer. That is hydrocarbons may flow from the tested layer into the wellbore, and at least some hydrocarbons in the adjacent layers may flow across the semi-permeable barrier(s) into the tested layer and the wellbore.

Referring to FIG. 1, illustrated is a reservoir environment 100 that includes a multi-layer reservoir 102 having a tested layer 120 separated from an adjacent layer 122 by a barrier layer ("barrier") 124. In some instances the barrier 124 is an impermeable barrier. For example, the barrier 124 can include a solid layer of rock that blocks the flow of hydrocarbons from the adjacent layer 122 to the tested layer 120. In such an instance the well 106 may produce hydrocarbons from the tested layer 120 (as illustrated by arrows 126), but may not produce hydrocarbons from the adjacent layer 122. That is, hydrocarbons may flow from the tested layer 120 into the wellbore 110, but hydrocarbons in the adjacent layer 122 may be blocked by the impermeable barrier 124 from flowing into the tested layer 120 and the wellbore 110. In such an instance the well production 112 may consist of production contributions from the tested layer 120.

In some instances the barrier 124 is a semi-permeable barrier. For example, the barrier 124 may include a porous layer of rock that generally inhibits the flow of hydrocarbons across the barrier 124, but that does allow at least some hydrocarbons to flow through the barrier 124. In such an instance the well 106 may produce hydrocarbons from the tested layer (as illustrated by arrows 126) and the adjacent layer 122 (as illustrated by arrows 128). That is hydrocarbons may flow from the tested layer 120 into the wellbore 110, and hydrocarbons in the adjacent layer 122 may flow across the barrier 124, into and through the tested layer 120, and into the wellbore 110. In such an instance the well production 112 may consist of production contributions from the tested layer 120 and production contributions from the adjacent layer 122.

A drainage region 130 can define a region of the tested layer 120 from which all of or substantially all of (e.g., greater than about 99% of) the contribution from tested layer 120 to the well production 112 is expected to originate. The extent of the drainage region 130 may be defined by a drainage boundary 132. The drainage boundary 132 may be defined by a radial distance from the wellbore 110 (or "drainage radius" ($r_d$)).

In some embodiments, the permeability of the barrier 124 is characterized by a specific fluid permeability ($F_{cb}$) of the barrier 124. A specific fluid permeability ($F_{cb}$) of zero may indicate that no fluid can migrate across the barrier 124, and a specific fluid permeability ($F_{cb}$) having a magnitude greater than zero may indicate that fluid can migrate across the barrier 124—with a higher magnitudes indicating that fluids can more easily migrate across the barrier 124. In some embodiments, it is determined that the barrier 124 is impermeable if it has a specific fluid permeability ($F_{cb}$) of zero, and it is determined that the barrier 124 is semi-permeable if it has a specific fluid permeability ($F_{cb}$) of a magnitude greater than zero. The magnitude of specific fluid permeability ($F_{cb}$) of the barrier 124 can be determined, for example, in accordance with the techniques described in U.S. Patent Publication No. 2016/0201452, published Jul. 14, 2016, which is hereby incorporated by reference in its entirety.

In an embodiment in which the barrier 124 is determined to be impermeable (e.g., the barrier 124 has a specific fluid permeability ($F_{cb}$) of a magnitude of zero), it can be determined that there is no production contribution from the adjacent layer 122, and an estimate of the drainage region 130 can be determined using well modeling techniques that ignore, or otherwise do not take into account, production contributions from the adjacent layer 122. In an embodiment in which the barrier 124 is determined to be semi-permeable (e.g., the barrier 124 has a specific fluid permeability ($F_{cb}$) of a magnitude greater than zero), it can be determined that there is, or at least there is a potential for, production contributions from the adjacent layer 122. The introduction of production contributions from the adjacent layer 122 can introduce complexities into determining the drainage region 130 for the well 106. Unfortunately, these complexities are not accounted for in well modeling techniques that ignore or otherwise do not take into account production contributions from the adjacent layer 122. The advanced well modeling techniques described herein do take into account production contributions from adjacent layers and thus can prove advantageous for determining the drainage region for a well when the barrier is determined to be semi-permeable. That is, the advanced well modeling techniques described herein can, for example, provide accurate determinations of the drainage region 130 for the well 106 where the barrier 124 is semi-permeable. In some embodiments, the advanced well modeling techniques consider pressure drawdowns and pressure derivatives deep inside multi-layer hydrocarbon reservoirs (e.g., in the reservoir at extended radial distances from the wellbore, not just at the wellbore) to determine a drainage region (e.g., defined by a drainage radius ($r_d$)) of a well producing from a tested layer and an adjacent layer separated from the tested layer by a semi-permeable barrier.

Figure 2:
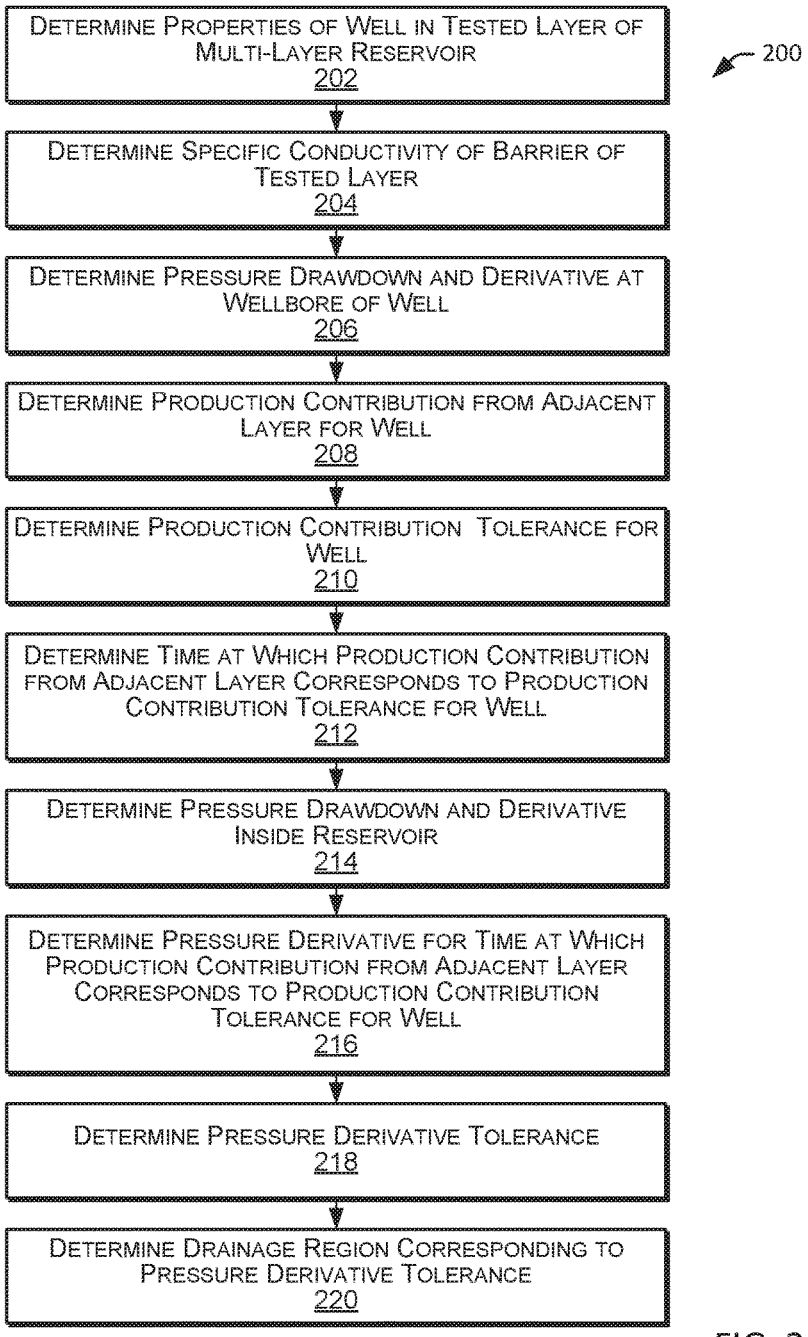
FIG. 2 is a flowchart that illustrates a method of determining a drainage region of a well in a multi-layer reservoir in accordance with one or more embodiments.

FIG. 2 is a flowchart that illustrates a method 200 of determining a well drainage region for a well of a multi-layer reservoir in accordance with one or more embodiments. In some embodiments, some or all of the operations of method 200 may be performed or controlled by the processing system 107.

In some embodiments, method 200 includes determining properties of a well in a tested layer of a multi-layer reservoir (block 202). Determining properties of the well can include determining properties of a tested layer, properties of one or more adjacent layers separated from the tested layer by one or more semi-permeable barriers, and/or properties of the one or more semi-permeable barriers. For example, determining properties of the well 106 can include the processing system 107 obtaining or otherwise determining properties of the tested layer 120, the adjacent layer 122, and/or the semi-permeable barrier 124 intersected by the wellbore 110.

In some embodiments, determining properties of reservoir layers (e.g., the tested layer 120, the adjacent layer 122, and/or the semi-permeable barrier 124) includes performing logging operations, performing well tests operations, and/or sample analysis operations.

The logging operations can include in situ logging operations that include running a logging tool into the wellbore 110 of the well 106 to assess characteristics of the wellbore 110 and/or the formation 104 surrounding the wellbore 110. The logging operations can include generating corresponding well logs, and at least some of the properties of the well 106 may be determined based on the well logs. The logging operations can include, for example, an open-hole logging operation that includes running a logging tool into the wellbore 110 of the well 106 to identify the type and location of rock along the length of the wellbore 110, including the type an location of the rock forming the tested layer 120, the adjacent layer 122 and/or the barrier 124. The logging operations can include, for example, a production logging operation that includes running a production logging tool into the wellbore 110 of the well 106, using the production logging tool to exert a hydraulic pressure on at least a portion of the wellbore 110 (e.g., the portion of the wellbore 110 that intersects the tested layer 120 and/or the adjacent layer 122) and recording a flow and/or pressure response overtime.

The well tests operations can include monitoring operations that are conducted during normal well operations and/or testing of the well 106. The well tests operations can include generating corresponding well test reports, and at least some of the properties of the well 106 may be determined based on the well test reports. The well tests operations can include, for example, recording measurements of wellbore flowrate and/or wellbore pressure from respective flowrate and/or pressure gauges located the surface and/or downhole in the wellbore 110 to determine respective measures of flowrate and pressure at the one or more locations in the wellbore 110.

The sample analysis operations can include extracting and analyzing samples (e.g., fluid and/or rock samples) from the reservoir. The sample analysis operations can include, for example, physically extracting a sample (e.g., fluid and/or rock sample) from the formation 104 (e.g., via the wellbore 110 or another bore hole drilled into the formation 104) and testing the sample in a lab at the surface to determine one more properties of the sample. The sample analysis operations can include generating corresponding sample reports, and at least some of the properties of the well 106 may be determined based on the sample reports.

In some embodiments, the properties can include rock, fluid, geometric and well properties. For example, the properties can include a barrier thickness ($h_0$) (e.g., indicative of the thickness of the barrier 124), compressibility of fluid ($c_o$) and/or compressibility of rock ($c_r$), fluid viscosity ($\mu$), a formation volume factor of reservoir fluid ($B_o$), pay thickness of each layer (h), permeability of each layer (k), porosity of reservoir rock ($\phi$), pressure data over time ($p_{wf}$), well production rate (q), reservoir pressure ($p_0$), skin factor (s), specific permeability ($F_{cb}$), wellbore storage constant (C), and/or wellbore radius ($r_{w1}$).

The barrier thickness ($h_0$) can be obtained, for example, via and open-hole logging operation. Compressibility of fluid ($c_o$) and/or compressibility of rock ($c_r$), fluid viscosity ($\mu$), and/or a formation volume factor of reservoir fluid ($B_o$), can be determined, for example, via analysis of fluid and/or rock samples extracted from the formation. Pay thickness of each layer (h) can be determined, for example, via open-holed logs, production logs and/or well test reports. Permeability of each layer (k) can be determined, for example, via well test reports, and/or analysis of extracted samples. Porosity of reservoir rock ($\phi$) can be determined, for example, via open-holed logs, well test reports, and/or analysis of extracted samples. Pressure data over time ($p_{wf}$), well production rate (q), reservoir pressure ($p_0$), skin factor ($s_1$), specific permeability ($F_{cb}$), and wellbore storage constant (C) can be determined, for example, via well test reports. Wellbore radius ($r_{w1}$) can be determined based on drilling and completion reports.

In some embodiments, method 200 includes determining a specific permeability of a barrier of the tested layer (block 204). Determining a specific permeability of a barrier of the tested layer can include determining a magnitude of a specific fluid permeability ($F_{cb}$) of a barrier separating a tested layer and an adjacent layer of the well. For example, determining a specific permeability of a barrier of the well 106 can include the processing system 107 determining a specific fluid permeability ($F_{cb}$) of the barrier 124 separating the tested layer 120 and the adjacent layer 122. In some embodiments, the specific fluid permeability ($F_{cb}$) of the barrier 124 can be determined in accordance with the techniques described in U.S. Patent Publication No. 2016/0201452.

In some embodiments, method 200 includes determining a pressure drawdown and a pressure derivative at the wellbore of the well (block 206). Determining a pressure drawdown and a pressure derivative at the wellbore of the well can include determining a pressure drawdown and a pressure derivative at the wellbore over time, based on the properties of the well and the specific fluid permeability ($F_{cb}$) of the barrier. For example, referring to the plot of pressure drawdown and derivative 300 of FIG. 3, determining a pressure drawdown at the wellbore 110 of the well 106 can include determining a pressure drawdown curve (or "profile") 304 indicative of a pressure drawdown over time, and determining a pressure derivative at the wellbore 110 of the well 106 can include the processing system 107 determining a pressure derivative curve (or "profile") 302 indicative of a pressure derivative over time. In some embodiments, the pressure drawdown curve 304 and the pressure derivative curve 302 are determined according to the following analytical process.

First and second derived parameters (Y and Z) can be determined according to the following:

$$Y = \frac{\kappa_1(F_{cb} + F_2 l) + \kappa_2(F_{cb} + F_1 l)}{\kappa_1 \kappa_2}, \tag{1}$$

$$Z = \frac{(F_{cb} + F_2 l)(F_{cb} + F_1 l) - F_{cb}^2}{\kappa_1 \kappa_2}, \tag{2}$$

where Y is a first derived parameter (having units of 1/feet ($1/ft^2$)), Z is a second derived parameter (having units of $1/ft^4$), $F_{cb}$ is the specific fluid permeability of the barrier 124, l is a Laplace transform parameter (having units of per hour (1/hr)), $k_1$ is permeability in the radial direction (horizontal)

in the tested layer 120 (having units of millidarcy (md)), $k_2$ is permeability in the radial direction (horizontal) in the adjacent layer 122 (having units of md), where $F_1$ and $F_2$ are defined as follows:

$$F_1 = \frac{\phi_1 \mu h_1 c_{t1}}{0.0002637}, \tag{3}$$

$$F_2 = \frac{\phi_2 \mu h_2 c_{t2}}{0.0002637}, \tag{4}$$

where $F_1$ and $F_2$ have units of feet*centipoise/pound per square inch absolute (ft-cP/psia), $\phi_1$ is a porosity of the tested layer 120, $\phi_2$ is a porosity of the adjacent layer 122, $h_1$ is a pay thickness of the tested layer 120, $h_2$ is a pay thickness of the adjacent layer 122 (having units of ft), $c_{t1}$ is a total system compressibility of the tested layer 120 (having units of 1/psia), and $c_{t2}$ is a total system compressibility of the adjacent layer 122 (having units of 1/psia). Notably, a subscript of 1 indicates that the respective parameter is for the tested layer 120 and a subscript of 2 indicates that the respective parameter is for the adjacent layer 122.

Third and fourth derived parameters ($\sigma_1$ and $\sigma_2$) can be determined from the first and second derived parameters (Y and Z) according to the following:

$$\sigma_1^2 = \frac{Y + \sqrt{Y^2 - 4Z}}{2}, \tag{5}$$

$$\sigma_2^2 = \frac{Y - \sqrt{Y^2 - 4Z}}{2}, \tag{6}$$

where $\sigma_1$ is a third derived parameter (having units of 1/ft), $\sigma_2$ is a fourth derived parameter (having units of 1/ft).

Fifth and sixth derived parameters ($\beta_1$ and $\beta_2$) can be determined from the third and fourth derived parameters ($\sigma_1$ and $\sigma_2$) according to the following:

$$\beta_1 = -\frac{F_{cb}}{\kappa_2 \sigma_1^2 - F_{cb} - F_2 l}, \tag{7}$$

$$\beta_2 = -\frac{F_{cb}}{\kappa_2 \sigma_2^2 - F_{cb} - F_2 l}, \tag{8}$$

where $\beta_1$ is a fifth derived parameter for the tested layer (having units of md-psia/cP), $\beta_1$ is a sixth derived parameter for the adjacent layer (having units of md-psia/cP).

Using the derived parameters, the pressure drawdown for the well 106 can be determined according to the following:

$$\Delta\overline{p}_{wf}(l) = \frac{qB_0\left\{K_0(\sigma_1 r_{wa1}) - \frac{\beta_1}{\beta_2}K_0(\sigma_2 r_{wa1})\right\}}{l\left[24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}\right]}, \tag{9}$$

where $\Delta\overline{p}_{wf}(l)$ is the pressure at the wellbore 110 of the well 106 over time, q is the rate of production in standard conditions from the wellbore 110 (having units of Stock Tank Barrels per Day (STB/d)), $B_o$ is a formation volume factor of fluid in both of the tested layer 120 and the adjacent layer 122 (having units of barrel/STB (bbl/STB)), $K_0(\ )$ is a modified Bessel function of the second kind of order 0 and $K_1(\ )$ is a modified Bessel function of the second kind of order 1, C is a wellbore storage constant (having units of bbl/psi), $r_{w1}$ is radius of wellbore 110 (having units of ft), $r_{wa1}$ is an equivalent wellbore radius due to a skin factor (having units of ft), and $\alpha_1$ is a flow parameter for the tested layer 120. The equivalent wellbore radius ($r_{wa1}$) due to a skin factor can be determined according to the following:

$$r_{wa1} = r_{w1}\exp(-s_1), \tag{10}$$

where $s_1$ is a skin factor for the tested layer 120. The flow parameter for the tested layer ($\alpha_1$) can be determined according to the following:

$$\alpha_1 = \frac{k_1 h_1 r_{w1}}{141.2\mu}, \tag{11}$$

where $\mu$ is a viscosity of fluid in both the tested layer 120 and the adjacent layer 122 (having units of cP).

Further, the pressure derivative for the well 106 can be determined according to the following:

$$\overline{p}'(r, l) = \frac{qB_0\left\{K_0(\sigma_1 r_{wa1}) - \frac{\beta_1}{\beta_2}K_0(\sigma_2 r_{wa1})\right\}}{24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}}, \tag{12}$$

where $\overline{p}'_{wf}(l)$ is the derivative of pressure for the well 106 (at the wellbore 110) over time.

Figure 3:
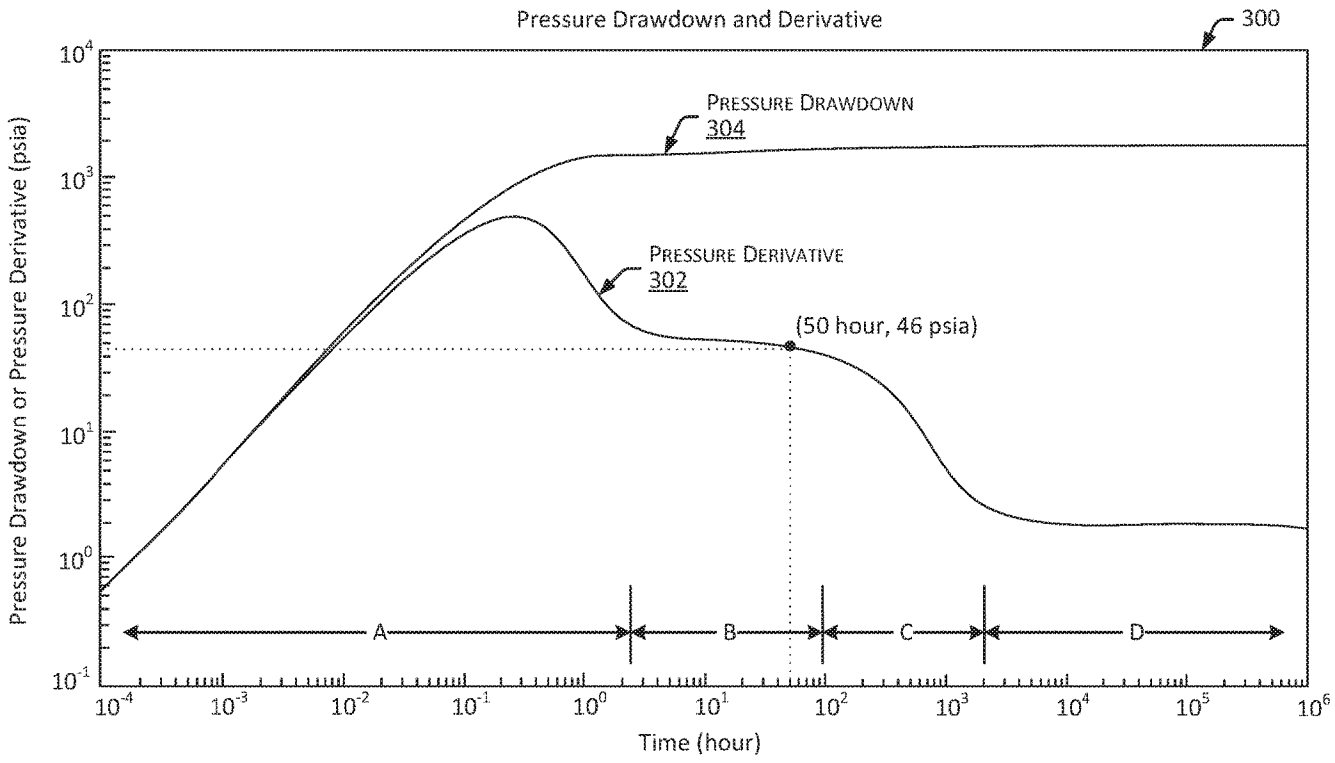
FIG. 3 illustrates plots of pressure drawdown and pressure derivative over time in accordance with one or more embodiments.

The pressure drawdown curve 304 and the pressure derivative curve 302 of FIG. 3 can be constructed by inverting Equation 9 and Equation 12, respectively, with the Stehfest algorithm to place them in the time domain. (See, e.g., Stehfest, H.: "Algorithm 368: Numerical Inversion of Laplace Transforms," Communications of ACM 13(1): 47-49, 1970).

Notably, the distinct flow regimes dominated by contributions of the tested layer 120 and the adjacent layer 122 can be identified in the plot of pressure drawdown and derivative 300 of FIG. 3. For example, a first regime (or first time period "A") can include period in which the changes in pressure are attributable to wellbore storage and a skin factor for the wellbore 110. A second regime (or second time period "B") can include period in which the changes in pressure are attributable primarily to contributions from the tested layer 120. The second regime may be identified by the first leveling off of the pressure derivative curve 302 following its peak (which occurred in the example embodiment less than three hours into the drawdown). A third regime (or third time period "C") can include a transition period in which the changes in pressure are attributable to contributions from the tested layer 120 and the adjacent layer 122, indicated by a drop-off of the pressure derivative curve 302 following the first leveling off of the pressure derivative curve 302. A fourth regime (or fourth time period "D") can include a transition period in which the changes in pressure are attributable primarily to contributions from the adjacent layer 122. The fourth regime may be identified by the second/final leveling off of the pressure derivative curve 302 after the drop-off of the pressure derivative curve 302.

Figure 4:
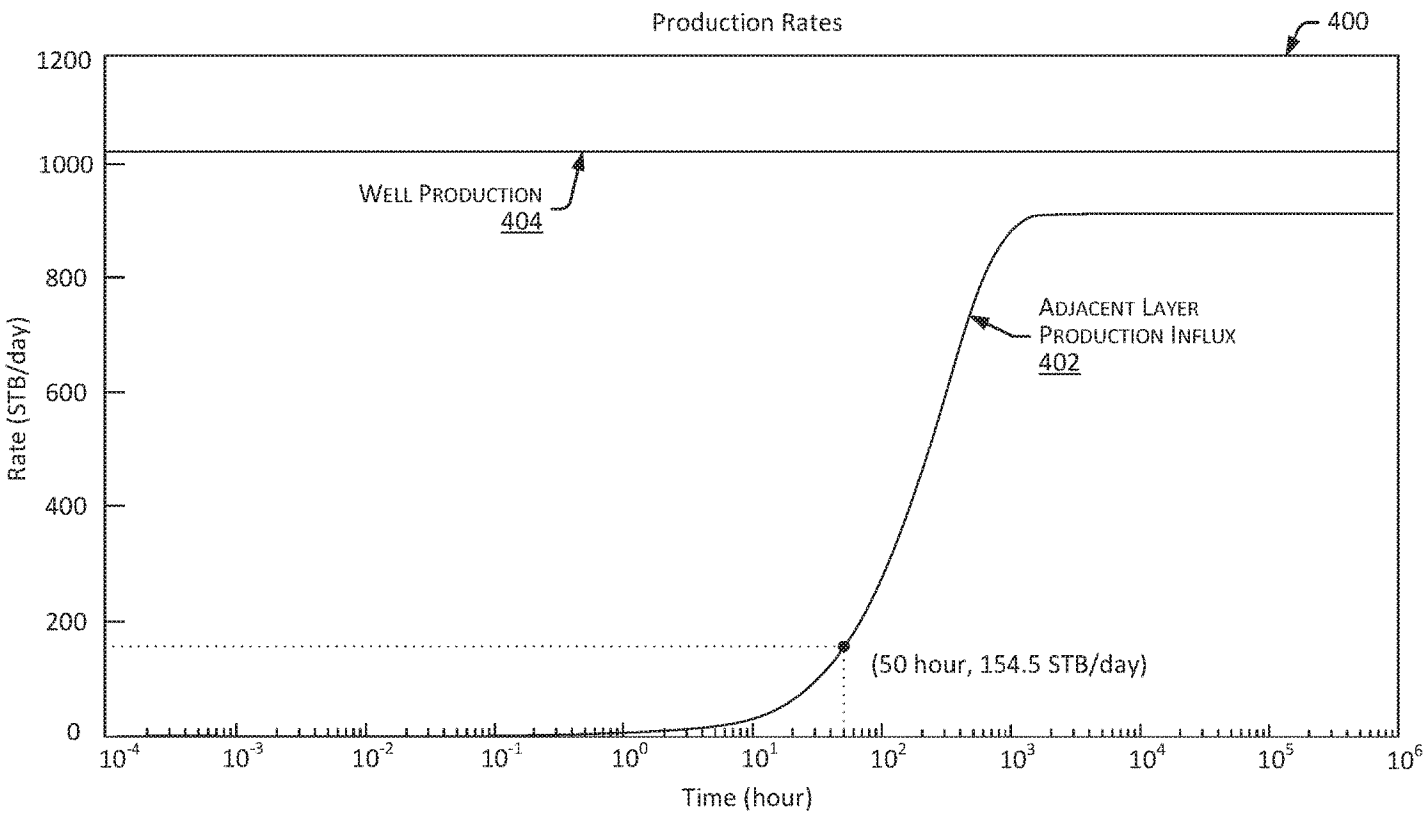
FIG. 4 illustrates plots of production rates from different reservoir layers over time in accordance with one or more embodiments.

In some embodiments, method 200 includes determining a production contribution from an adjacent layer for the well (block 208). Determining a production contribution from an adjacent layer for the well can include determining a rate of influx of production from an adjacent layer over time, based on the properties of the well and the specific fluid permeability ($F_{cb}$) of the barrier. For example, referring to the plot of production rates 400 of FIG. 4, determining a production contribution from the adjacent layer 122 for the well 106 can include the processing system 107 determining an adjacent layer production influx curve 402 indicative of a rate of influx of production from the adjacent layer 122 over time. During the presented duration of production rates 400 of FIG. 4, the well production rate 404 has been constant. In some embodiments, the adjacent layer production influx curve 402 is determined according to the following:

$$\bar{q}_2(l) = \frac{qF_{cb}\left[\frac{(1-\beta_1)}{\sigma_1^2} - \frac{\beta_1(1-\beta_2)}{\beta_2\sigma_2^2}\right]}{141.2\mu l\left[24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}\right]}, \tag{13}$$

where $\bar{q}_2(l)$ is the rate of production contribution from the adjacent layer 122 in the Laplace domain for a constant rate of production from the well (q) 404. In some embodiments, the adjacent layer production influx curve 402 of FIG. 4 is constructed by inverting Equation 13 with the Stehfest algorithm to place it in the time domain.

Notably, the rate of production contribution from the adjacent layer 122 can have an increase over time, as the hydrocarbons originally located in tested layer 120 are produced, and the well 106 begins to draw an increasing amount of production from the adjacent layer 122, across the semi-permeable barrier 124. For example, referring to the adjacent layer production influx curve 402 of FIG. 4, the production rate from the adjacent layer sees a dramatic increase from about hour 10 to about hour 1,000. FIG. 4 also includes a well production curve 404 indicative of the total production rate from the well 106 over time. The production rate 404 from the well 106 over time has been specified constant for further potential utilization in variable-rate conditions with the principle of superposition. The total production rate 404 from the well 106 can include contributions of production from both of the tested layer 120 and the adjacent layer 122. As can be determined from the plot of production rate 400 of FIG. 4, the production contributions of the tested layer 120 can diminish over time as the well draws an increasing amount of production from the adjacent layer 122.

In some embodiments, method 200 includes determining a production contribution tolerance for the well (block 210). Determining a production contribution tolerance for the well can include determining a maximum amount of production from an adjacent layer to be tolerated, which can be a component of the reservoir management strategy. For example, determining a production contribution tolerance for the well 106 can include the processing system 107 determining a maximum amount of production from the adjacent layer 122 that is to be tolerated. In some embodiments, the production contribution tolerance for a well is expressed as a percentage of the total production for the well. For example, the production contribution tolerance for the well 106 can be set at 15% of the total production for the well 106. In some embodiments, the production contribution tolerance for a well is selected by an operator of the well 106. For example, an engineer operating the well 106 may select a 15% production contribution tolerance or another tolerance for the well 106 based on experience or strategic management practices of acceptable levels of production contribution from adjacent layers, and provide the value as an input to the processing system 107.

In some embodiments, method 200 includes determining a time at which the production contribution from the adjacent layer(s) of the well corresponds to the production contribution tolerance for the well (block 212). Determining a time at which the production contribution from the adjacent layer(s) of the well corresponds to the production contribution tolerance for the well can include determining a time at which the adjacent layer production influx curve for the well has a value that corresponds to the production contribution tolerance for the well. For example, referring to FIG. 4, where the production contribution tolerance for the well 106 is 15% of the total production for the well 106 and the well 106 is determined to have a steady rate of total production of about 1,030 STB/day (as illustrated by the well production curve 404), determining a time at which the production contribution from the adjacent layer(s) of the well corresponds to the production contribution tolerance for the well can include the processing system 107 determining a time of hour 50 based on the adjacent layer production influx curve 402 having a value of about 154.5 STB/day (about 15% of 1,030 STB/day) at hour 50.

In some embodiments, method 200 includes determining pressure drawdown and pressure derivative inside the reservoir (block 214). Determining the pressure drawdown and the pressure derivative inside the reservoir can include determining a pressure drawdown and a pressure derivative across a radial distance from the wellbore (extending into the reservoir) for one or multiple points in time. Determining the pressure drawdown and the pressure derivative inside the reservoir for multiple points in time can generate a "time-lapse" of the pressure drawdown and the pressure derivative inside the reservoir that illustrates changes in the pressure drawdown and the pressure derivative inside the reservoir (across a radial distance from the wellbore) over time. For example, referring to the plots of pressure drawdowns and derivatives 500 and 500' of FIGS. 5A and 5B, respectively, determining the pressure drawdown and the pressure derivative inside the reservoir 102 of the well 106 can include the processing system 107 determining pressure drawdown curves 502 (e.g., indicating pressure change inside of the reservoir 102 compared to the initial pressure versus a radial distance from the wellbore 110) and pressure derivative curves 504 (e.g., indicating a derivative of the pressure inside of the reservoir 102 versus a radial distance from the wellbore 110) for different points in time (e.g., for hours 1, 10, 50, 100 and 1,000). In the illustrated embodiment, for example, the pressure drawdown curves 502 include five individual pressure drawdown curves 502*a*, 502*b*, 502*c*, 502*d* and 502*e* corresponding to pressure drawdowns at hours 1, 10, 50, 100 and 1,000, respectively. The pressure derivative curves 504 include five individual pressure derivative curves 504*a*, 504*b*, 504*c*, 504*d* and 504*e* corresponding to derivatives of the pressure drawdowns at hours 1, 10, 50, 100 and 1,000, respectively. In some embodiments, each of the pressure drawdown curves 502 is determined according to the following:

$$\Delta\overline{p}_{wf}(r, l) = \frac{qB_0\left\{K_0(\sigma_1 r) - \frac{\beta_1}{\beta_2}K_0(\sigma_2 r)\right\}}{l\left[24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}\right]}, \tag{14}$$

where $\Delta\overline{p}_{wf}(r, l)$ is the pressure at the radial distance (r) from the longitudinal axis of the wellbore 110 of the well 106 at a given time. In some embodiments, each of the pressure derivative curves 504 is determined according to the following:

$$\overline{p}'(r, l) = \frac{qB_0\left\{K_0(\sigma_1 r) - \frac{\beta_1}{\beta_2}K_0(\sigma_2 r)\right\}}{24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}}, \tag{15}$$

where $\overline{p}'(r, l)$ is the derivative of pressure in the Laplace domain at the radial distance (r) from the longitudinal axis of the wellbore 110 of the well 106 at a given time. The pressure drawdown curves 502 and the pressure derivative curves 504 of FIGS. 5A and 5B can be constructed by inverting Equation 14 and Equation 15, respectively, with the Stehfest algorithm to place them in the time domain.

Figure 5A:
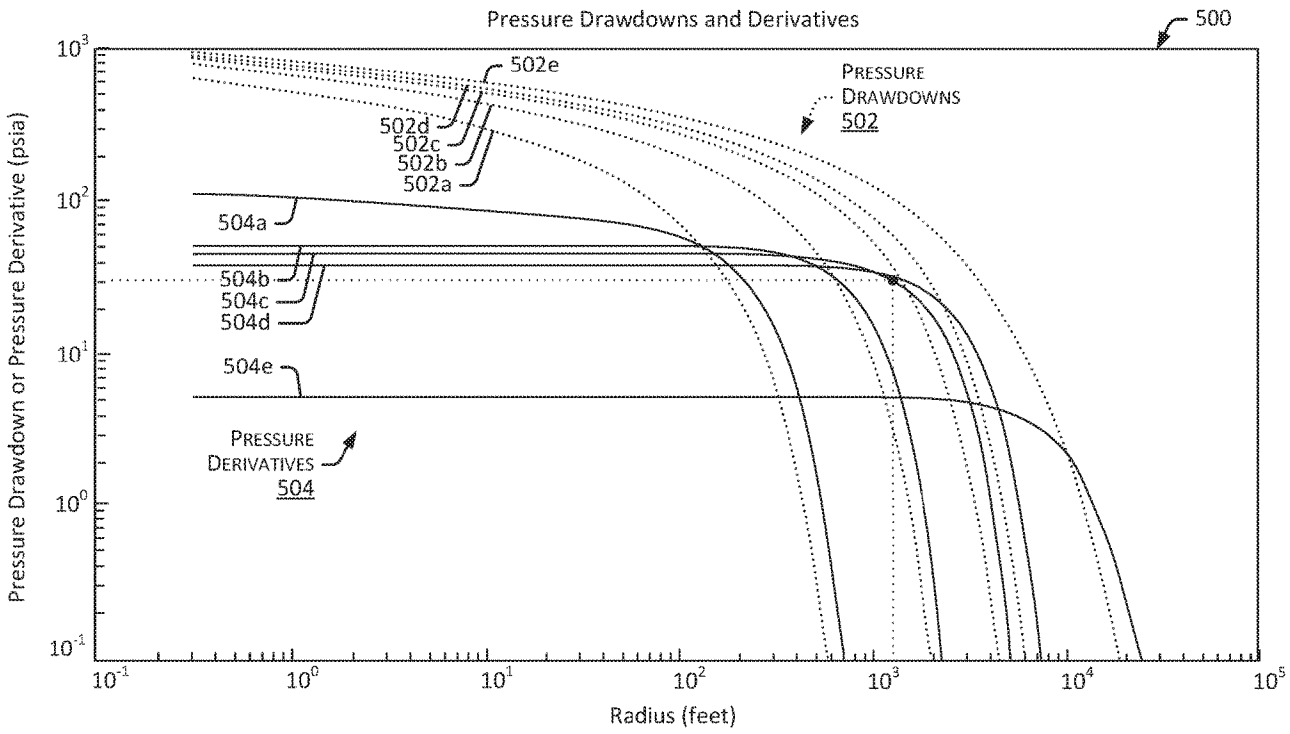
FIGS. 5A and 5B illustrate plots of pressure drawdowns and pressure derivatives versus radial distance at different times in accordance with one or more embodiments.

Referring to FIG. 5A, notably the pressure derivative curves 504 demonstrate more significant features than the corresponding pressure drawdown curves 502. For example, the pressure derivative curves 504 have a relatively constant value up to a given distance, followed by a relatively abrupt drop-off In contrast, the pressure drawdown curves 502 have a relatively continuous drop-off that increases over distance. Thus, the pressure derivative curves 504 can be used for subsequent determinations, including identifying the location of a corresponding drainage radius.

In some embodiments, if the time at which the production contribution from the adjacent layer(s) of the well corresponds to the production contribution tolerance for the well is known, determining the pressure derivative and pressure drawdown inside the reservoir can include determining a pressure drawdown and a pressure derivative across a radial distance from the wellbore (extending into the reservoir) for that time. For example, referring to FIG. 5B and the above example where hour 50 is determined to be the time at which the production contribution from the adjacent layer 122 of the well 106 corresponds to the production contribution tolerance of 15% for the well 106, only the pressure drawdown curve 502*c* and the pressure derivative curve 504*c* corresponding to hour 50 may be generated. This can save processing overhead associated with generating the other curves of the time-lapse.

In some embodiments, method 200 includes determining a pressure derivative for the time at which the production contribution from the adjacent layer(s) of the well corresponds to the production contribution tolerance for the well (block 216). Determining a pressure derivative for the time at which the production contribution from the adjacent layer(s) of the well corresponds to the production contribution tolerance for the well can include determining a point of the pressure derivative curve 302 for the time at which the production contribution from the adjacent layer(s) of the well corresponds to the production contribution tolerance for the well. For example, referring to FIG. 3, where hour 50 is determined to be the time at which the production contribution from the adjacent layer(s) of the well corresponds to the production contribution tolerance for the well 106, determining a pressure derivative for the time at which the production contribution from the adjacent layer(s) of the well corresponds to the production contribution tolerance for the well can include the processing system 107 determining a value of about 46 psia based on the pressure derivative curve 302 having a value of about 46 psia at hour 50.

In some embodiments, method 200 includes determining a pressure derivative tolerance for the well (block 218). Determining a pressure derivative tolerance for the well can include determining a maximum amount of deviation from the pressure derivative determined for the time at which the production contribution from the adjacent layer(s) of the well corresponds to the production contribution tolerance for the well. For example, determining a pressure derivative tolerance for the well 106 can include the processing system 107 determining a maximum amount of deviation from 46 psia (the pressure derivative determined for hour 50 (the time at which the production contribution from the adjacent layer 122 of the well corresponds to the production contribution tolerance for the well 106)). In some embodiments, the pressure derivative tolerance for a well is expressed as a percentage of the pressure derivative. For example, the pressure derivative tolerance for the well 106 may be set at 20% of the pressure derivative. In some embodiments, the pressure derivative tolerance for a well is selected by an operator of the well 106. For example, an engineer operating the well 106 may select a 20% pressure derivative tolerance for the well 106 based on experience of acceptable levels of deviations from pressure derivative, and provide the value as an input to the processing system 107.

Figure 5B:
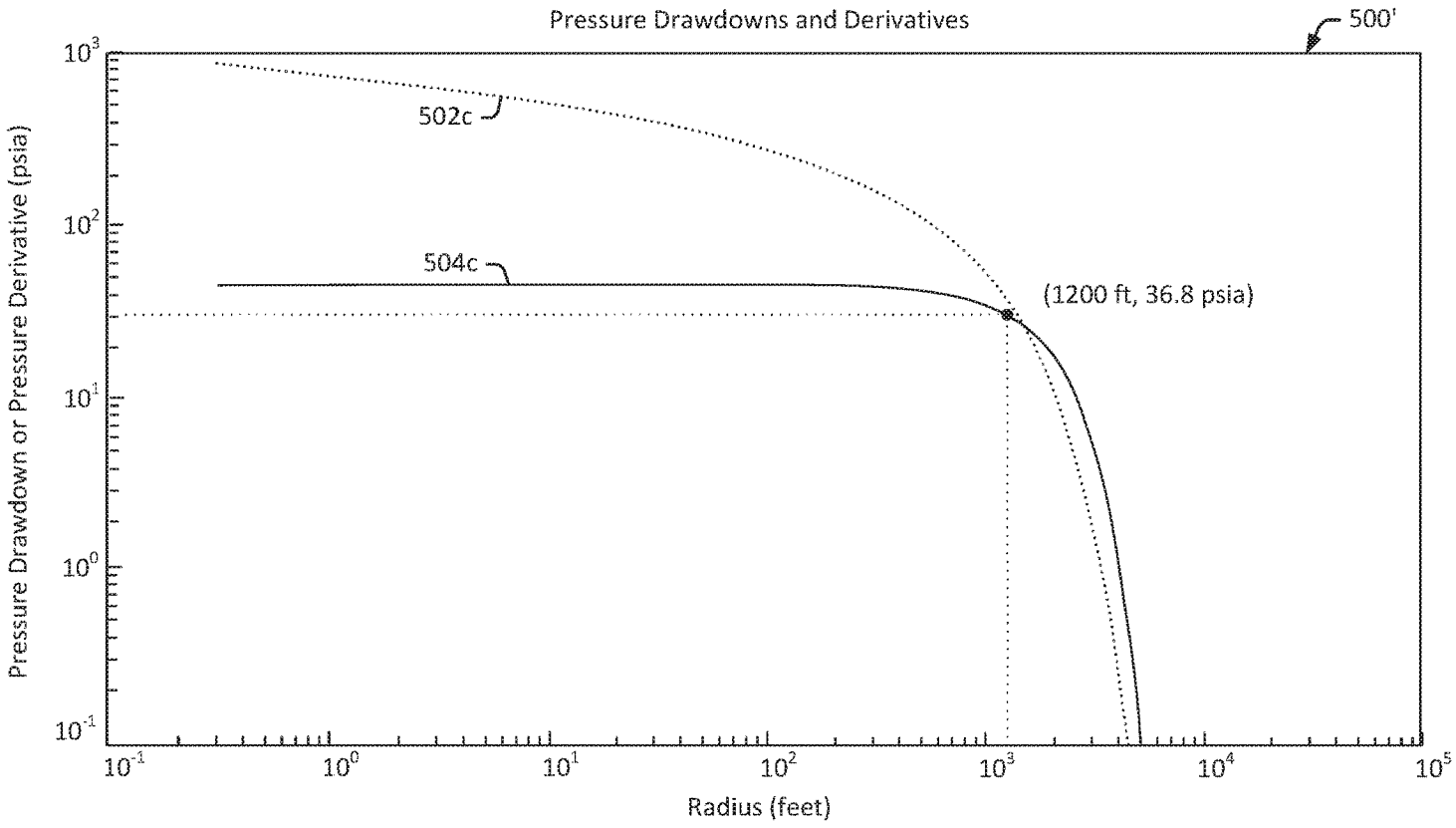

In some embodiments, method 200 includes determining a drainage region that corresponds to the pressure derivative tolerance for the well (block 220). Determining a drainage region that corresponds to the pressure derivative tolerance for the well can include determining a point of a pressure derivative curve (for the time at which the production contribution from the adjacent layer(s) of the well corresponds to the production contribution tolerance for the well) that corresponds to the pressure derivative tolerance for the well. The point can indicate a drainage radius for the well, and the drainage radius can be used to define the drainage region for the well. The determination can include the processing system 107 determining a deviated pressure derivative that deviates by the pressure derivative tolerance from the pressure derivative of 46 psia (the pressure derivative determined for hour 50 (the time at which the production contribution from the adjacent layer 122 of the well corresponds to the production contribution tolerance for the well 106)), and determining a radius of the pressure derivative curve 504 that corresponds to the deviated pressure. For example, determining a drainage region that corresponds to the pressure derivative tolerance for the well 106 can include the processing system 107 determining a point of the pressure derivative curve 504*c* (for hour 50) that corresponds to the pressure derivative tolerance of 20% for the well 106. Referring to FIGS. 5A and 5B, the point of the pressure derivative curve 504*c* may be determined as about (1200, 36.8), which represents a radius of 1,200 ft and a pressure derivative of 36.8 psia (e.g., 80% of 46 psia, or a 20% deviation from 46 psia). Accordingly, the determination can include determining a deviated pressure derivative of 36.8 psia and determining a radius of 1,200 ft for the point of the pressure derivative curve 504*c* that corresponds to the deviated pressure derivative of 36.8 psia. In some embodiments, the drainage region for the well can be defined as the radius corresponding to the deviated pressure derivative. For example, the drainage boundary 132 for the well 106 can be defined by a drainage radius ($r_d$) of 1,200 ft, and the drainage region 130 for the well 130 can be defined by the region of the tested layer 120 within the drainage boundary 132 (e.g., within 1,200 ft of the wellbore 110).

The following table includes a listing of example parameters and respective values that can be used to arrive at the example values described above, and the data (e.g., the curves) illustrated in FIGS. 3-5B.

TABLE 1

| Tested Layer | Adjacent Layer | Barrier | Fluid | Well |
|---|---|---|---|---|
| $k_1$ = 115 md | $k_2$ = 380 md | $k_{v0}$ = 0.0007 md | $\mu$ = 0.75 cP | C = 0.01 bbl/psi |
| $k_{v1}$ = 11.5 md | $k_{v2}$ = 38 md | $h_0$ = 4 ft | $B_o$ = 1.3367 bbl/STB | q = 1,030 STB/d |
| $\phi_1$ = 0.18 | $\phi_2$ = 0.18 | | | $p_0$ = 2,965 psia |
| $h_1$ = 12 ft | $h_2$ = 100 ft | | | $s_1$ = +7.2 |
| $c_{t1}$ = 1.0e−5/psi | $c_{t2}$ = 1.0e−5/psi | | | $r_{w1}$ = 0.3 ft |
| | | | | $F_{cb}$ = 1.7494e−4 md/ft |

Notably, in the above described modeling, the well is considered to be producing at a constant rate of q (STB/d), while the pressure drawdown, the pressure derivative and the crossflow rate are observed. The Laplace transforms have been performed on the quantities which are time-dependent to make the original partial differential equations solvable. Note that the equations for the pressure drawdown $\Delta p_{wf}$ at the wellbore, the pressure derivative $p'_{wf}$ at the wellbore and the crossflow rate from the adjacent layer to the tested layer are presented in the Laplace domain as $\Delta\bar{p}_{wf}$, $\bar{p}'_{wf}$ and $\bar{q}_2$, respectively. Similarly, the equations for spatial pressure drawdown and pressure derivative in the reservoir are presented in the Laplace domain. Thus, as indicated herein, the values of these equations can be inverted back to the time domain with the Stehfest algorithm.

In some embodiments, the characteristics of the drainage region are used to determine well spacings. For example, a radius of the drainage region for a first well and a radius of a drainage region for a second well can be added to determine an appropriate well spacing between the first and second wells. In some embodiments, the well spacings are used to generate an FDP. The FDP can, for example, specify well locations and well trajectories that correspond to the well spacings determined. In some embodiments, the multi-layer hydrocarbon reservoir is developed according to the FDP. For example, wells can be drilled at one or more of the well locations specified in the FDP, and having the respective well trajectories. Thus, the determinations of well drainage regions can be used, for example, to determine optimal well spacings and FDPs, and ultimately as a basis to effectively develop a multi-layer hydrocarbon reservoir with a tested layer and one or more adjacent layers separated from the tested layer by one or more semi-permeable barriers.

Figure 6:
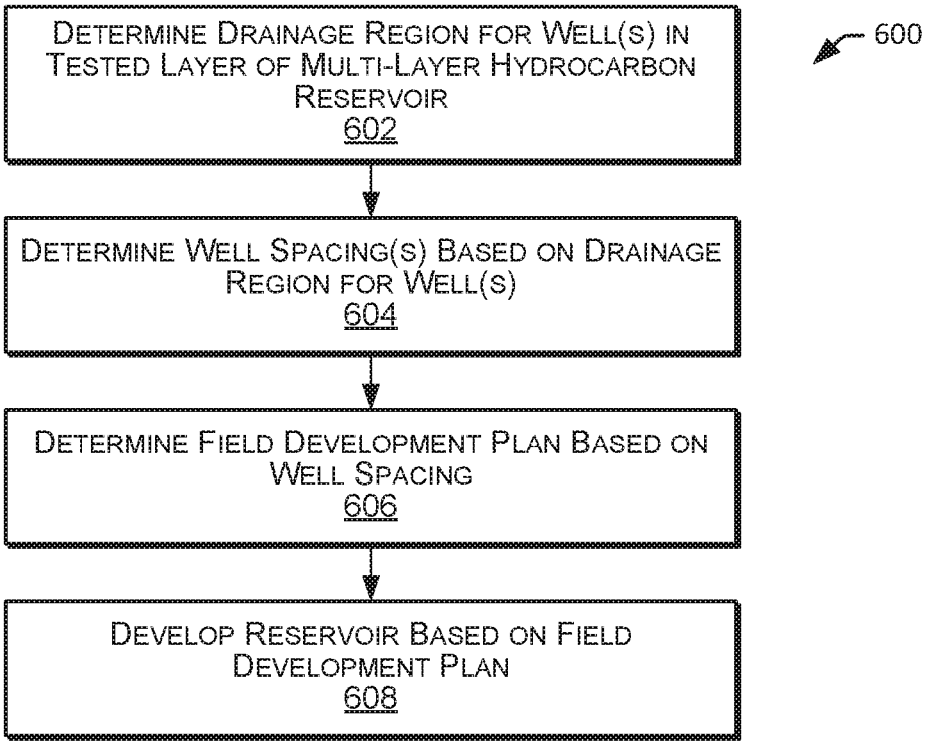
FIG. 6 is a flowchart that illustrates a method of developing a field of wells in accordance with one or more embodiments.

FIG. 6 is a flowchart that illustrates a method 600 of developing a multi-layer hydrocarbon reservoir in accordance with one or more embodiments. In some embodiments, some or all of the operations of method 600 may be performed or controlled by the processing system 107.

In some embodiments, method 600 includes determining a drainage region for one or more wells in a tested layer of a multi-layer hydrocarbon reservoir (block 602). Determining a drainage region for one or more wells in a tested layer of a multi-layer hydrocarbon reservoir can include the processing system 107 determining a drainage region for each of some or all of one or more wells drilled or to be drilled in a multi-layer hydrocarbon reservoir, for example, using the techniques for determining a well drainage region for a well of a multi-layer reservoir of method 200 described with regard to FIG. 2. For example, determining a drainage region for one or more wells in a tested layer can include determining a drainage radius of 1,200 ft defining the drainage region 130 for the well 106. A similar determination can be provided for each of some or all of other wells drilled (or to be drilled) in the tested layer 120 of the reservoir 122.

Figure 7:
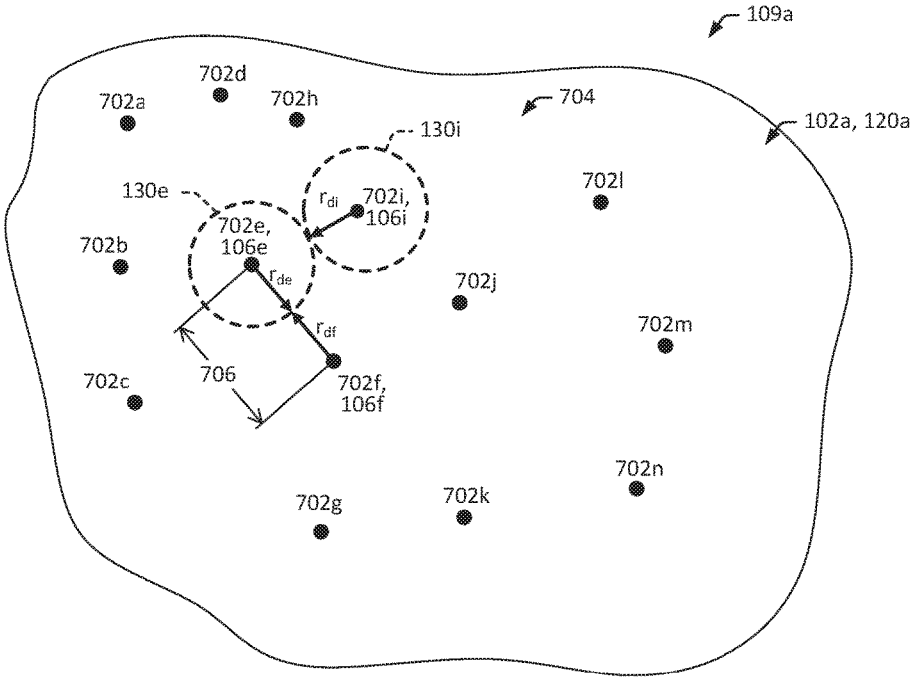
FIG. 7 is a diagram that illustrates a top view of development of a reservoir in accordance with one or more embodiments.

FIG. 7 is a diagram that illustrates a top view of an example field development plan (FDP) 109*a* for a multi-layer hydrocarbon reservoir 102*a* in accordance with one or more embodiments. In the illustrated embodiment, the FDP 109 includes fourteen well sites 702 (e.g., including well sites 702*a*-702*n*) for wells to be drilled into a tested layer 120*a* of the reservoir 102*a*. In some embodiments, one or more of the well sites 702 can include existing wells. For example, well sites 702*e* and 702*i* may include existing wells 106*e* and 106*i*, respectively. In some embodiments, the drainage region for each of some or all of the existing wells can be determined in accordance with techniques for determining a well drainage region for a well of a multi-layer reservoir of method 200 described with regard to FIG. 2. For example, a drainage region 130*e* for the well 106*e* may be defined by a determined drainage radius ($r_{de}$) of 1,200 ft and a drainage region 130*i* for the well 106*i* may be defined by a determined drainage radius ($r_{di}$) of 1,500 ft, determined in accordance with techniques of method 200.

In some embodiments, method 600 includes determining well spacing based on the drainage region(s) for the well(s) (block 604). Determining well spacing based on determined drainage region(s) for the well(s) can include determining well spacing for one or more wells of a field of wells for the tested layer based on the one or more determined drainage regions for the one or more wells. The well spacing may define the distance between adjacent well sites of a development. A well spacing for a well and an adjacent well may be determined as twice (or another multiplier indicated by the variations of reservoir and fluid properties) the drainage radius for the well. For example, referring to FIG. 7, determining well spacing based on determined drainage regions for the wells can include the processing system 107 determining a well spacing for one or more of the well sites 702 (e.g., including well sites 702*a*-702*n*) based on the drainage region 130*e* for the well 106*e* and/or the drainage region 130*i* for the well 106*i*. For example, a well spacing 2,400 ft may be determined for some or all of the well sites 702 (e.g., including well sites 702*a*-702*n*) of the development 700 based on the determined drainage radius ($r_{de}$) of 1,200 ft for the well 106*e* and the determined drainage radius ($r_{df}$) of 1,200 ft for the well 106*f* (e.g., 1,200+1,200 ft=2,400 ft). In some embodiments, the well spacing may be determined based on drainage regions for multiple wells. For example, a well spacing of 2,200 ft may be determined for some or all of the well sites 702 (e.g., including well sites 702*a*-702*n*) based on nominal summation of the drainage radii around individual wells, including the determined drainage radius ($r_{de}$) of 1,200 ft for the well 106*e* and the determined drainage radius ($r_{di}$) of 1,500 ft for the well 106*i* (e.g., 1,200 ft+1,500 ft=2,700 ft). Thus, a well spacing may be determined based on a determined drainage radius ($r_d$) for one or more wells in a tested layer of a multi-layer hydrocarbon reservoir.

In some embodiments, method 600 includes determining a field development plan (FDP) based on the determined well spacing (block 606). Determining an FDP based on the determined well spacing can include determining one or more well sites for wells of a field of wells to be developed for the tested layer. For example, referring to FIG. 7, determining an FDP based on the determined well spacing can include the processing system 107 determining the surface locations of the one or more well sites 702 (e.g., including well sites 702*a*-702*n*) for wells drilled or to be drilled into the tested layer 120*a*. Where a well spacing of 2,400 ft is determined, this can include, for example, generating an FDP (e.g., FDP 109*a*) identifying each of the well site locations 702*a*-702*n* having a spacing of about 2,400 ft between adjacent pairs of the well sites 702. For example, well site 702*f* and well site 702*e* can have a well spacing 706 of about 2,400 ft. In some embodiments, the FDP can define the location of the well sites 702 (e.g., including well sites 702*a*-702*n*) and a respective wellbore trajectory (or "path") for each of the well sites 702.

In some embodiments, method 600 includes developing the reservoir based on the FDP (block 608). Developing the reservoir based on the FDP can include drilling a well at each of some or all of the well sites defined by the FDP. For example, developing the tested layer based on the FDP 109*a* can include the processing system 107 controlling drilling a wellbore 110*f* at the well site 702*f* that follows a wellbore trajectory specified for the well site 702*f* by the FDP 109*a*, to create a well 106*f* in the tested layer 120*a* of the reservoir 102*a* having a well spacing 706 of about 2,400 ft from wellsite 702*e* and well 106*e*. Such a process can be repeated for some or all of the well sites 702 of the FDP 109*a*. In some embodiments, the well system 106 includes a well drilling system (e.g., a drilling rig for operating a drill bit) to cut the wellbore into the formation. In some embodiments, some or all of the resulting wells can be operated as production wells to extract hydrocarbons from the reservoir 102*a*, including contributions from the tested layer 120*a* and one or more adjacent layers of the reservoir separated from the tested layer 120*a* by one or more semi-permeable barriers. In some embodiments, the FDP 109*a* (or at least a representation of a well trajectory for a well at a well site) can be presented to a driller that controls drilling of a wellbore at one or more of the well sites to follow the associated well trajectory for the well site, to generate the well for the well site according to the FDP 109*a*.

Figure 8:
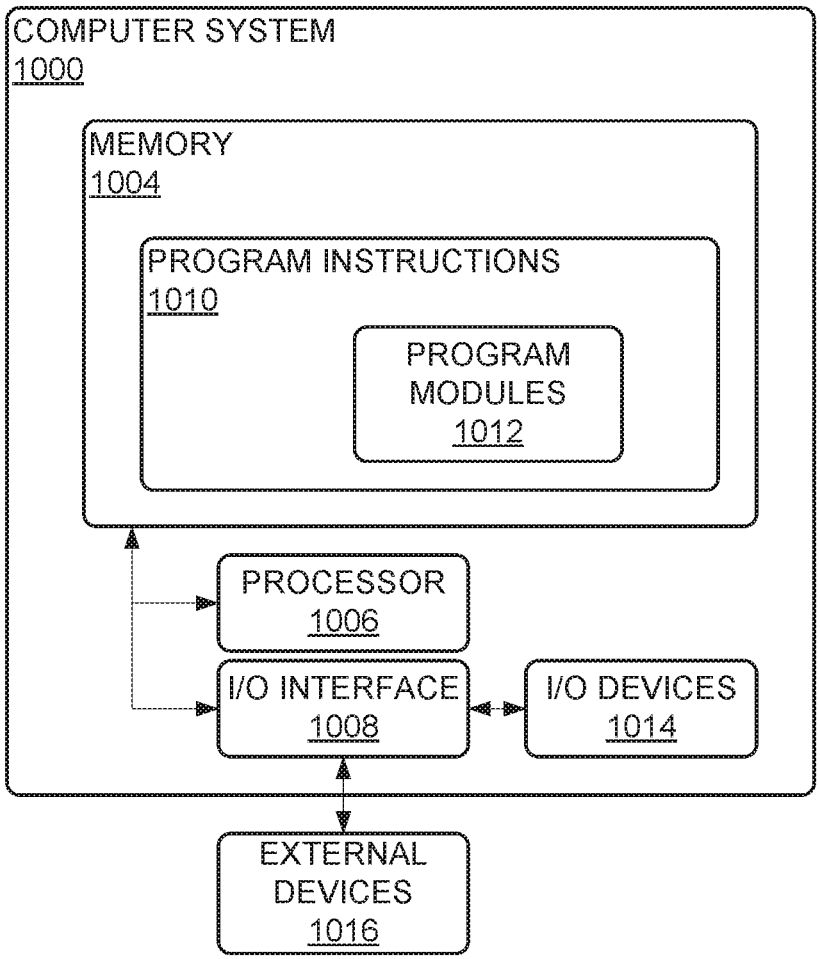
FIG. 8 is a diagram that illustrates an example computer system in accordance with one or more embodiments.

FIG. 8 is a diagram that illustrates an example computer system (or "system") 1000 in accordance with one or more embodiments. The system 1000 may include a memory 1004, a processor 1006 and an input/output (I/O) interface 1008. The memory 1004 may include one or more of non-volatile memory (for example, flash memory, read-only memory (ROM), programmable read-only memory (PROM), erasable programmable read-only memory (EPROM), electrically erasable programmable read-only memory (EEPROM)), volatile memory (for example, random access memory (RAM), static random access memory (SRAM), synchronous dynamic RAM (SDRAM)), and bulk storage memory (for example, CD-ROM or DVD-ROM, hard drives). The memory 1004 may include a non-transitory computer-readable storage medium having program instructions 1010 stored thereon. The program instructions 1010 may include program modules 1012 that are executable by a computer processor (for example, the processor 1006) to cause the functional operations described, such as those described with regard to the processing system 107, method 200 and/or method 600.

The processor 1006 may be any suitable processor capable of executing program instructions. The processor 1006 may include a central processing unit (CPU) that carries out program instructions (e.g., the program instructions of the program module(s) 1012) to perform the arithmetical, logical, and input/output operations described. The processor 1006 may include one or more processors. The I/O interface 1008 may provide an interface for communication with one or more I/O devices 1014, such as a joystick, a computer mouse, a keyboard, and a display screen (e.g., an electronic display for displaying a graphical user interface (GUI)). The I/O devices 1014 may include one or more of the user input devices. The I/O devices 1014 may be connected to the I/O interface 1008 via a wired connection (e.g., Industrial Ethernet connection) or a wireless connection (e.g., a Wi-Fi connection). The I/O interface 1008 may provide an interface for communication with one or more external devices 1016, such as other computers and networks. In some embodiments, the I/O interface 1008 includes one or both of an antenna and a transceiver. In some embodiments, the external devices 1016 include one or more of logging devices, drilling devices, down-hole and/or surface pressure gauges, down-hole and/or surface flow meters, and/or the like.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as examples of embodiments. Elements and materials may be substituted for those illustrated and described herein, parts and processes may be reversed or omitted, and certain features of the embodiments may be utilized independently, all as would be apparent to one skilled in the art after having the benefit of this description of the embodiments. Changes may be made in the elements described herein without departing from the spirit and scope of the embodiments as described in the following claims. Headings used herein are for organizational purposes only and are not meant to be used to limit the scope of the description.

It will be appreciated that the processes and methods described herein are example embodiments of processes and methods that may be employed in accordance with the techniques described herein. The processes and methods may be modified to facilitate variations of their implementation and use. The order of the processes and methods and the operations provided therein may be changed, and various elements may be added, reordered, combined, omitted, modified, etc. Portions of the processes and methods may be implemented in software, hardware, or a combination thereof. Some or all of the portions of the processes and methods may be implemented by one or more of the processors/modules/applications described herein.

As used throughout this application, the word "may" is used in a permissive sense (i.e., meaning having the potential to), rather than the mandatory sense (i.e., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (for example, via an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A method of developing a hydrocarbon reservoir comprising:

drilling a well comprising a wellbore extending into a tested layer of a multi-layer hydrocarbon reservoir, the well located at a first well site;

identifying a barrier located between the tested layer and an adjacent layer of the multi-layer hydrocarbon reservoir;

determining properties of the well including a specific fluid permeability of the barrier;

determining, based on the specific fluid permeability of the barrier, a pressure drawdown of the well comprising a profile of pressure at the wellbore of the well over a period of time;

determining, based on the pressure drawdown of the well, a pressure derivative of the well comprising a derivative of the profile of the pressure at the wellbore of the well over the period of time;

determining a production contribution of the adjacent layer comprising a profile of a rate of influx of production fluid across the barrier from the adjacent layer and into the tested layer over the period of time;

determining a total production rate for the well;

determining a production contribution tolerance value for the well comprising a portion of the total production rate for the well;

determining, based on the production contribution of the adjacent layer, a first point in time corresponding to the production contribution tolerance value, the first point in time comprising a point in time at which a value of the profile of the rate of influx of production fluid across the barrier from the adjacent layer and into the tested layer corresponds to the production contribution tolerance value for the well;

determining, based on the pressure derivative of the well, a first pressure corresponding to the first point in time, the first pressure comprising a value of the derivative of the profile of pressure at the wellbore at the first point in time;

determining, based on the specific fluid permeability of the barrier, a reservoir pressure of the well corresponding to the first point in time comprising a profile of pressure in the targeted layer as a function of radial distance from the wellbore of the well at the first point in time;

determining, based on the reservoir pressure of the well corresponding to the first point in time, a reservoir pressure derivative of the well corresponding to the first point in time comprising a derivative of the profile of pressure in the targeted layer as a function of radial distance from the wellbore of the well at the first point in time;

determining a pressure derivative tolerance value for the well comprising a portion of the reservoir pressure of the well corresponding to the first point in time;

determining, based on the reservoir pressure derivative corresponding to the first point in time, a radial distance corresponding to the pressure derivative tolerance value;

determining a drainage radius for the well corresponding to the radial distance;

determining a well spacing based on the drainage radius for the well; and drilling a second well at a second well site located a distance from the first well site, the distance corresponding to the well spacing.

2. The method of claim 1, wherein the specific fluid permeability of the barrier indicates an ability of fluids to migrate through the barrier, and wherein determining properties of the well includes determining that the specific fluid permeability of the barrier has a magnitude that is greater than zero.

3. The method of claim 1, wherein determining properties of the well comprises conducting one or more of a logging operation, a well test operation, and a sample analysis operation.

4. The method of claim 1, wherein the production contribution tolerance value for the well comprises a product of the total production rate for the well and a production contribution tolerance percentage.

5. The method of claim 1, further comprising:

determining, based on the specific fluid permeability of the barrier, a time-lapse of reservoir pressure in the targeted layer comprising a plurality of profiles of pressure in the targeted layer as a function of radial distance from the wellbore of the well at different points in time, wherein each profile of the plurality of profiles of pressure in the targeted layer comprises a profile of pressure in the targeted layer as a function of radial distance from the wellbore of the well at a point in time of the different points in time; and determining, based on the time-lapse of a reservoir pressure of the well, time-lapse of a derivative of reservoir pressure of the well comprising a plurality of profiles of a derivative reservoir pressure for the well at different points in time, wherein each pressure derivative profile of the plurality of pressure derivative profiles for the well comprises a derivative of a profile of pressure in the targeted layer as a function of radial distance from the wellbore of the well at a point in time of the different points in time, wherein one of the different points in time corresponds to the first point in time, wherein determining the reservoir pressure of the well corresponding to the first point in time comprising the profile of pressure in the targeted layer as a function of radial distance from the wellbore of the well at the first point in time comprises determining the profile of the plurality of profiles of pressure in the targeted layer corresponding to the first point in time, and wherein determining the pressure derivative of the well comprising a derivative of the profile of the pressure at the wellbore of the well over the period of time comprises determining the profile of the plurality of profiles of the derivative reservoir pressure for the well corresponding to the first point in time.

6. The method of claim 1, wherein the well spacing is twice the drainage radius for the well.

7. The method of claim 1, further comprising generating a field development plan (FDP) comprising a plurality of well sites having well spacings corresponding to the well spacing determined.

8. A method of developing a hydrocarbon reservoir comprising:

determining properties of a well located at a first well site and comprising a wellbore extending into a tested layer of a multi-layer hydrocarbon reservoir comprising a barrier located between the tested layer and an adjacent layer of the multi-layer hydrocarbon reservoir, the properties of the well including a specific fluid permeability of the barrier;

determining, based on the specific fluid permeability of the barrier, a pressure derivative of the well comprising a derivative of a profile of the pressure at the wellbore well over a period of time;

determining a production contribution of the adjacent layer comprising a profile of a rate of influx of production fluid across the barrier from the adjacent layer and into the tested layer over the period of time;

determining a total production rate for the well;

determining a production contribution tolerance value for the well comprising a portion of the total production rate for the well;

determining, based on the production contribution of the adjacent layer, a first point in time corresponding to the production contribution tolerance value, the first point in time comprising a point in time at which a value of the profile of the rate of influx of production fluid across the barrier from the adjacent layer and into the tested layer corresponds to the production contribution tolerance value for the well;

determining, based on the pressure derivative of the well, a first pressure corresponding to the first point in time, the first pressure comprising a value of the derivative of the profile of pressure at the wellbore at the first point in time;

determining, based on the specific fluid permeability of the barrier, a reservoir pressure derivative of the well corresponding to the first point in time comprising a derivative of a profile of pressure in the targeted layer as a function of radial distance from the wellbore of the well at the first point in time;

determining a pressure derivative tolerance value for the well comprising a portion of the reservoir pressure of the well corresponding to the first point in time;

determining, based on the reservoir pressure derivative corresponding to the first point in time, a radial distance corresponding to the pressure derivative tolerance value; and determining a drainage radius for the well corresponding to the radial distance.

9. The method of claim 8, wherein the specific fluid permeability of the barrier indicates an ability of fluids to migrate through the barrier, and wherein determining properties of the well includes determining that the specific fluid permeability of the barrier has a magnitude that is greater than zero.

10. The method of claim 8, wherein determining properties of the well comprises conducting one or more of a logging operation, a well test operation, and a sample analysis operation.

11. The method of claim 8, wherein the production contribution tolerance value for the well comprise product of the total production rate for the well and a production contribution tolerance percentage.

12. The method of claim 8, further comprising:

determining, based on the specific fluid permeability of the barrier, the pressure drawdown of the well comprising the profile of pressure at the wellbore of the well over the period of time; and determining, based on the specific fluid permeability of the barrier, the reservoir pressure of the well corresponding to the first point in time comprising the profile of pressure in the targeted layer as a function of radial distance from the wellbore of the well at the first point in time.

13. The method of claim 12, further comprising:

determining, based on the specific fluid permeability of the barrier, a time-lapse of reservoir pressure in the targeted layer comprising a plurality of profiles of pressure in the targeted layer as a function of radial distance from the wellbore of the well at different points in time, wherein each profile of the plurality of profiles of pressure in the targeted layer comprises a profile of pressure in the targeted layer as a function of radial distance from the wellbore of the well at a point in time of the different points in time; and determining, based on the time-lapse of a reservoir pressure of the well, time-lapse of a derivative of reservoir pressure of the well comprising a plurality of profiles of a derivative reservoir pressure for the well at different points in time, wherein each pressure derivative profile of the plurality of pressure derivative profiles for the well comprises a derivative of a profile of pressure in the targeted layer as a function of radial distance from the wellbore of the well at a point in time of the different points in time, wherein one of the different points in time corresponds to the first point in time, wherein determining the reservoir pressure of the well corresponding to the first point in time comprising the profile of pressure in the targeted layer as a function of radial distance from the wellbore of the well at the first point in time comprises determining the profile of the plurality of profiles of pressure in the targeted layer corresponding to the first point in time, and wherein determining the pressure derivative of the well comprising a derivative of the profile of the pressure at the wellbore of the well over the period of time comprises determining the profile of the plurality of profiles of the derivative reservoir pressure for the well corresponding to the first point in time.

14. The method of claim 13, wherein the profile of pressure in the targeted layer as a function of radial distance from the wellbore of the well at the first point in time is determined according to the following:

$$\Delta\overline{p}_{wf}(r, l) = \frac{qB_0\left\{K_0(\sigma_1 r) - \frac{\beta_1}{\beta_2}K_0(\sigma_2 r)\right\}}{l\left[24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}\right]},$$

where $\Delta\overline{p}_{wf}(r, l)$ is the pressure at the radial distance (r) from the longitudinal axis of the wellbore of the well at the first point in time, and where $$\beta_1 = -\frac{F_{cb}}{\kappa_2\sigma_1^2 - F_{cb} - F_2 l}, \beta_2 = -\frac{F_{cb}}{\kappa_2\sigma_2^2 - F_{cb} - F_2 l},$$

$$\sigma_1^2 = \frac{Y + \sqrt{Y^2 - 4Z}}{2}, \sigma_2^2 = \frac{Y - \sqrt{Y^2 - 4Z}}{2},$$

$$F_1 = \frac{\phi_1\mu h_1 c_{t1}}{0.0002637}, F_2 = \frac{\phi_2\mu h_2 c_{t2}}{0.0002637},$$

$$\kappa_1 = k_1 h_1, \kappa_2 = k_2 h_2,$$

$$Y = \frac{\kappa_1(F_{cb} + F_2 l) + \kappa_2(F_{cb} + F_1 l)}{\kappa_1\kappa_2},$$

$$Z = \frac{(F_{cb} + F_2 l)(F_{cb} + F_1 l) - F_{cb}^2}{\kappa_1\kappa_2}, r_{wa1} = r_{w1}\exp(-s_1),$$

$$\alpha_1 = \frac{k_1 h_1 r_{w1}}{141.2\mu}, F_{cb} = \frac{2k_{v0}k_{v1}k_{v2}}{2h_0 k_{v1}k_{v2} + h_1 k_{v0}k_{v2} + h_2 k_{v0}k_{v1}},$$

$F_{cb}$ is the specific fluid permeability of the barrier,
l is a Laplace transform parameter,
$k_1$ is permeability in the radial direction in the tested layer,
$k_2$ is permeability in the radial direction in the adjacent layer,
$k_{v0}$ is permeability in the vertical direction in the barrier,
$k_{v1}$ is permeability in the vertical direction in the tested layer,
$k_{v2}$ is permeability in the vertical direction in the adjacent layer,
$\phi_1$ is a porosity of the tested layer,
$\phi_2$ is a porosity of the adjacent layer,
$h_0$ is a thickness of the barrier between the tested and the adjacent layers,
$h_1$ is a pay thickness of the tested layer,
$h_2$ is a pay thickness of the adjacent layer,
$\kappa_1$ is a flow capacity in the tested layer, $k_1h_1$,
$\kappa_2$ is a flow capacity in the adjacent layer, $k_2h_2$,
$c_{t1}$ is a total system compressibility of the tested layer,
$c_{t2}$ is a total system compressibility of the adjacent layer,
$B_o$ is a formation volume factor of fluid in both of the tested layer and the adjacent layer,
C is a wellbore storage constant (having units of bbl/psia),
$s_1$ is a skin factor of the well in the tested layer,
$\mu$ is a viscosity of fluid in both the tested layer and the adjacent layer,
$r_{w1}$ is a radius of the wellbore,
q is a rate of production for the well,
$K_0(\ )$ is a modified Bessel function of the second kind of order 0, and
$K_1(\ )$ is a modified Bessel function of the second kind of order 1.

15. The method of claim 14, wherein the derivative of the profile of pressure in the targeted layer as a function of radial distance from the wellbore of the well at the first point in time is determined according to the following:

$$\overline{p}'(r, l) = \frac{qB_0\left\{K_0(\sigma_1 r) - \frac{\beta_1}{\beta_2}K_0(\sigma_2 r)\right\}}{24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}},$$

where $\overline{p}'(r, l)$ is a derivative of pressure in Laplace domain at a radial distance (r) from a longitudinal axis of the wellbore of the well.

16. The method of claim 8, further comprising determining a well spacing based on the drainage radius for the well.

17. The method of claim 16, further comprising drilling a second well at a second well site located a distance from the first well site, the distance corresponding to the well spacing.

18. A non-transitory computer readable medium comprising program instructions stored thereon that are executable by a processor to perform operations for developing a hydrocarbon reservoir comprising:

determining properties of a well located at a first well site and comprising a wellbore extending into a tested layer of a multi-layer hydrocarbon reservoir comprising a barrier located between the tested layer and an adjacent layer of the multi-layer hydrocarbon reservoir, the properties of the well including a specific fluid permeability of the barrier;

determining, based on the specific fluid permeability of the barrier, a pressure derivative of the well comprising a derivative of a profile of the pressure at the wellbore well over a period of time;

determining a production contribution of the adjacent layer comprising a profile of a rate of influx of production fluid across the barrier from the adjacent layer and into the tested layer over the period of time;

determining a total production rate for the well;

determining a production contribution tolerance value for the well comprising a portion of the total production rate for the well;

determining, based on the production contribution of the adjacent layer, a first point in time corresponding to the production contribution tolerance value, the first point in time comprising a point in time at which a value of the profile of the rate of influx of production fluid across the barrier from the adjacent layer and into the tested layer corresponds to the production contribution tolerance value for the well;

determining, based on the pressure derivative of the well, a first pressure corresponding to the first point in time, the first pressure comprising a value of the derivative of the profile of pressure at the wellbore at the first point in time;

determining, based on the specific fluid permeability of the barrier, a reservoir pressure derivative of the well corresponding to the first point in time comprising a derivative of a profile of pressure in the targeted layer as a function of radial distance from the wellbore of the well at the first point in time;

determining a pressure derivative tolerance value for the well comprising a portion of the reservoir pressure of the well corresponding to the first point in time;

determining, based on the reservoir pressure derivative corresponding to the first point in time, a radial distance corresponding to the pressure derivative tolerance value; and determining a drainage radius for the well corresponding to the radial distance.

19. A system for developing a hydrocarbon reservoir comprising:

a well processing system configured to:

determine properties of a well located at a first well site and comprising a wellbore extending into a tested layer of a multi-layer hydrocarbon reservoir comprising a barrier located between the tested layer and an adjacent layer of the multi-layer hydrocarbon reservoir, the properties of the well including a specific fluid permeability of the barrier;

determine, based on the specific fluid permeability of the barrier, a pressure derivative of the well comprising a derivative of a profile of the pressure at the wellbore well over a period of time;

determine a production contribution of the adjacent layer comprising a profile of a rate of influx of production fluid across the barrier from the adjacent layer and into the tested layer over the period of time;

determine a total production rate for the well;

determine a production contribution tolerance value for the well comprising a portion of the total production rate for the well;

determine, based on the production contribution of the adjacent layer, a first point in time corresponding to the production contribution tolerance value, the first point in time comprising a point in time at which a value of the profile of the rate of influx of production fluid across the barrier from the adjacent layer and into the tested layer corresponds to the production contribution tolerance value for the well;

determine, based on the pressure derivative of the well, a first pressure corresponding to the first point in time, the first pressure comprising a value of the derivative of the profile of pressure at the wellbore at the first point in time;

determine, based on the specific fluid permeability of the barrier, a reservoir pressure derivative of the well corresponding to the first point in time comprising a derivative of a profile of pressure in the targeted layer as a function of radial distance from the wellbore of the well at the first point in time;

determine a pressure derivative tolerance value for the well comprising a portion of the reservoir pressure of the well corresponding to the first point in time;

determine, based on the reservoir pressure derivative corresponding to the first point in time, a radial distance corresponding to the pressure derivative tolerance value; and determine a drainage radius for the well corresponding to the radial distance; and a drilling system configured to:

drill one or more wells into the tested layer of the multi-layer hydrocarbon reservoir according to a well spacing determined based on the drainage radius for the well.

* * * * *